US006398346B1

(12) United States Patent
Anderson et al.

(10) Patent No.: US 6,398,346 B1
(45) Date of Patent: Jun. 4, 2002

(54) DUAL-CONFIGURABLE PRINT HEAD ADDRESSING

(75) Inventors: Frank Edward Anderson, Sadieville; George Keith Parish, Winchester, both of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/537,255

(22) Filed: Mar. 29, 2000

(51) Int. Cl.[7] ..... B41J 2/05; B41J 29/38

(52) U.S. Cl. ..... 347/57; 347/10; 347/11; 347/12; 347/14

(58) Field of Search ..... 347/57, 12, 11, 347/42, 14, 23, 19, 15, 10

(56) References Cited

U.S. PATENT DOCUMENTS

| | | | |
|---|---|---|---|
| 3,686,678 | A | 8/1972 | Robbins et al. |
| 4,216,480 | A | 8/1980 | Buehner et al. |
| 4,528,572 | A | 7/1985 | Sasaki et al. |
| 4,578,689 | A | 3/1986 | Spencer et al. |
| 4,683,479 | A | 7/1987 | Horiya et al. |
| 4,719,477 | A | 1/1988 | Hess |
| 4,814,790 | A | 3/1989 | Nitta |
| 4,887,098 | A | 12/1989 | Hawkins et al. |
| 4,893,133 | A | 1/1990 | Ohmori et al. |
| 5,028,812 | A | 7/1991 | Bartky |
| 5,057,855 | A | 10/1991 | Damouth |
| 5,081,474 | A | 1/1992 | Shibata et al. |
| 5,089,831 | A | 2/1992 | Ito et al. |
| 5,103,246 | A | 4/1992 | Dunn |
| 5,117,374 | A | 5/1992 | Goetz |
| 5,122,812 | A | 6/1992 | Hess et al. |
| 5,146,236 | A | 9/1992 | Hirata et al. |
| 5,508,724 | A | 4/1996 | Boyd et al. |
| 5,541,629 | A | 7/1996 | Saunders et al. |
| 5,568,171 | A | 10/1996 | Keefe et al. |
| 5,598,189 | A | 1/1997 | Hess et al. |

(List continued on next page.)

*Primary Examiner*—John Barlow
*Assistant Examiner*—Charles W. Stewart, Jr.
(74) *Attorney, Agent, or Firm*—D. Brent Lambert; Mark P. Crockett

(57) ABSTRACT

An ink jet print head is controllable based at least in part on q number of first control signals and p number of second control signals. The print head includes a print head integrated circuit chip having ink-heating resistors for generating heat when activated. The print head chip also has a switching circuit for receiving the first and second control signals, and for selectively activating the resistors by allowing electrical current to flow through selected resistors based at least in part on the first and second control signals. The switching circuit is operable in either a first operating mode or a second operating mode, where q is equivalent to $q_1$ in the first operating mode, and is equivalent to $q_2$ in the second operating mode, and where $q_1$ is twice $q_2$. In the first operating mode, p is equivalent to $p_1$, and in the second operating mode, p is equivalent to $p_2$, where $p_2$ is twice $p_1$. The product of $q_1$ multiplied by $p_1$ is equivalent to the product of $q_2$ multiplied by $p_2$. The print head also includes an operating mode selection circuit connected to the print head integrated circuit. The configuration of the operating mode selection circuit determines whether the switching circuit operates in the first operating mode or the second operating mode. When in the first operating mode, the print head requires four passes across a print medium to completely print an image, while in the second operating mode, the print head requires only two passes. Thus, a print head implemented according to the second operating mode offers a higher performance design point. However, a print head implemented according to the first operating mode is less expensive to manufacture. Therefore, the invention provides a single print head integrated circuit chip which may be used for two different cost/performance design points, the selection of which depends upon the configuration of the operating mode selection circuit.

23 Claims, 16 Drawing Sheets

U.S. PATENT DOCUMENTS 5,600,353 A 2/1997 Hickman et al.
5,610,638 A 3/1997 Courtney
5,644,342 A 7/1997 Argyres
5,648,805 A 7/1997 Keefe et al.
5,790,140 A * 8/1998 Koizumi et al. ..... 347/12

* cited by examiner

DUAL-CONFIGURABLE PRINT HEAD ADDRESSING

FIELD OF THE INVENTION

The present invention is generally directed to ink jet printers. More particularly, the invention is directed to an ink jet print head integrated circuit chip that supports two different drive schemes to provide two different levels of performance at two different printer costs.

BACKGROUND OF THE INVENTION

Ink jet printers form images on a print medium by ejecting droplets of ink from nozzles in a print head as the print head translates across the print medium. The nozzles are generally arranged in one or more columns that are aligned orthogonal to the direction of translation of the print head. Ink is ejected from a selected nozzle when an ink-heating resistor associated with the selected nozzle is activated based on print control signals.

Generally, in a three-dimensional nozzle addressing scheme, nozzle selection is based upon a combination of three sets of control signals. These control signals are typically carried from printer controller electronics to contacts on the print head by way of a flexible wiring harness. These signals are carried from the print head contacts to the print head integrated circuit chip by way of a tape automated bonding (TAB) circuit, with each control signal in the three sets of signals being carried by a separate metal conductor in the TAB circuit. These metal conductors in the TAB circuit and the corresponding conductors in the flexible wiring harness represent a significant portion of the total cost of an ink jet printer.

In the past, print head integrated circuit designs have supported a single print head drive scheme which provided a single print resolution and print speed as determined by the layout of the integrated circuit chip. This limits the usefulness of the chip design to a narrow performance range.

Since conventional print head integrated circuit chip designs have been limited to a single drive scheme, the number of control lines that connect the chip to the printer electronics have also been limited to a particular number. Thus, achieving a different printer cost by changing the number of control lines has in the past required a completely different print head chip design.

Therefore, a single print head integrated circuit chip that supports more than one cost/performance design point is needed.

SUMMARY OF THE INVENTION

The foregoing and other needs are met by an ink jet print head which is controllable based at least in part on q number of first control signals and p number of second control signals. The print head includes a print head integrated circuit chip having ink-heating resistors for generating heat when activated. The print head chip also has a switching circuit for receiving the first and second control signals, and for selectively activating the ink-heating resistors by allowing electrical current to flow through selected ink-heating resistors based at least in part on the first and second control signals. The switching circuit is operable in either a first operating mode or a second operating mode, where q is equivalent to $q_1$ in the first operating mode, and is equivalent to q2 in the second operating mode, and where $q_1$ is greater than $q_2$. In a most preferred embodiment, $q_1$ is twice $q_2$. In the first operating mode, p is equivalent to $p_1$, and in the second operating mode, p is equivalent to $p_2$, where $p_2$ is greater than $p_1$. Most preferably $p_2$ is twice $p_1$. In the most preferred embodiment, the product of $q_1$ multiplied by $p_1$ in the first operating mode is equivalent to the product of $q_2$ multiplied by $p_2$ in the second operating mode. The print head also includes an operating mode selection circuit connected to the print head integrated circuit. The operating mode selection circuit determines, based on a configuration of the operating mode selection circuit, whether the switching circuit operates in the first operating mode or the second operating mode.

In the first operating mode, the print head requires four passes across a print medium to completely print an image, while in the second operating mode, the print head requires only two passes. Thus, a print head implemented according to the second operating mode offers a higher performance design point. However, a print head implemented according to the first operating mode is less expensive to manufacture. Therefore, the invention provides a single print head integrated circuit chip which may be used for two different cost/performance design points, the selection of which depends upon the configuration of the operating mode selection circuit.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
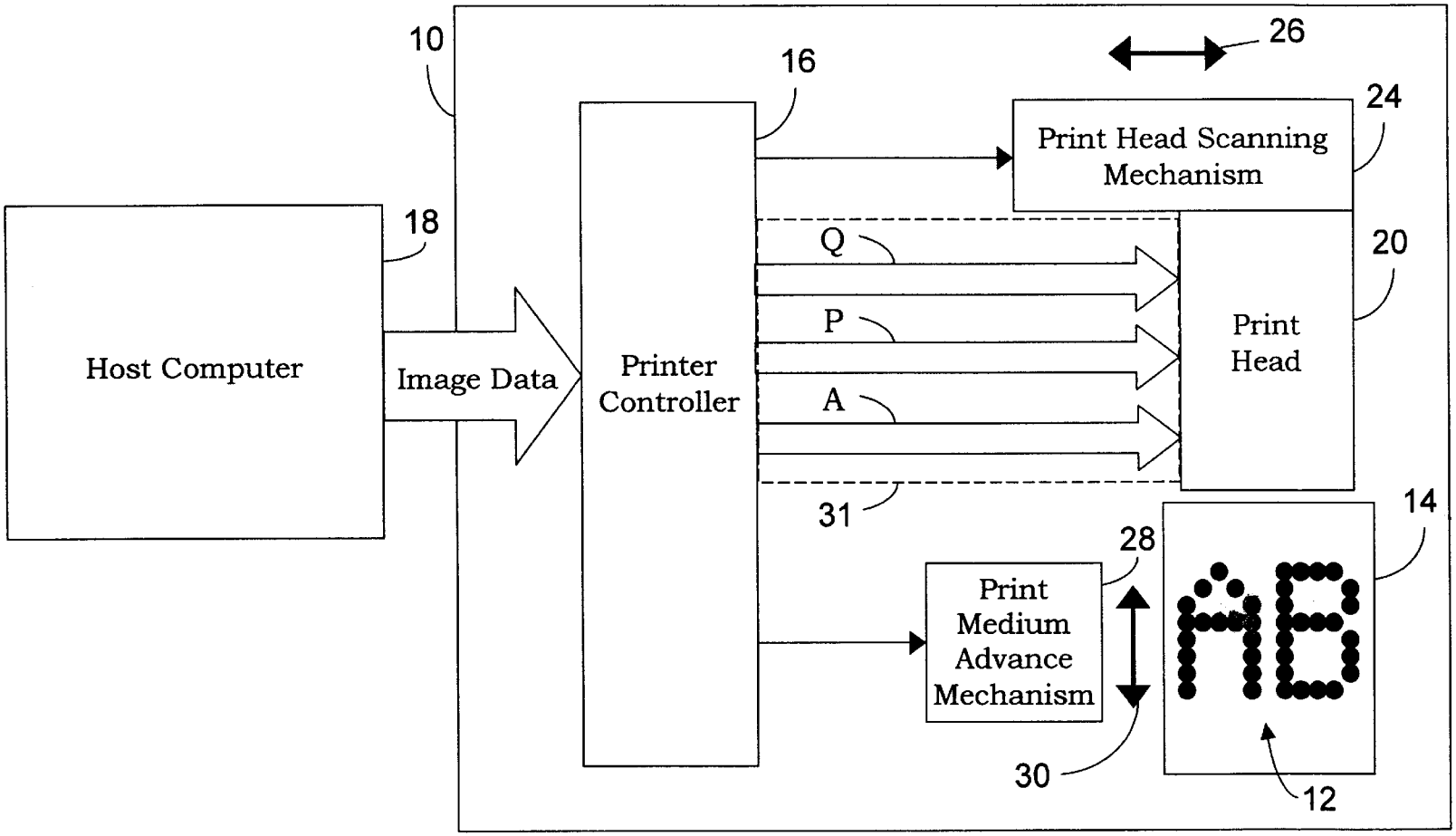
FIG. 1 is a functional block diagram of an ink jet printer according to a preferred embodiment of the invention.

Shown in FIG. 1 is a functional block diagram of an ink jet printer 10 for printing an image 12 on a print medium 14. The printer 10 includes a printer controller 16, such as a digital microprocessor, that receives image data from a host computer 18. Generally, the image data generated by the host computer 18 describes the image 12 in a bit-map format. Such a format represents the image 12 as a collection of pixels, or picture elements, in a two-dimensional rectangular coordinate system. For each pixel, the image data indicates the rectangular coordinates of the pixel on the print medium 14 and whether the pixel is on or off (printed or not printed). Typically, the host computer 18 "rasterizes" the image data by dividing the image 12 into horizontal rows of pixels, stepping from pixel-to-pixel across each row, and writing out the image data for each pixel according to each pixel's order in the row.

Based on the image data from the host computer 18, the printer controller 16 generates print control signals. In the preferred three-dimensional addressing system of the present invention, these control signals include first, second, and third control signals. The first, second, and third control signals are also referred to herein as quad select signals, address signals, and primitive signals.

Figure 2:
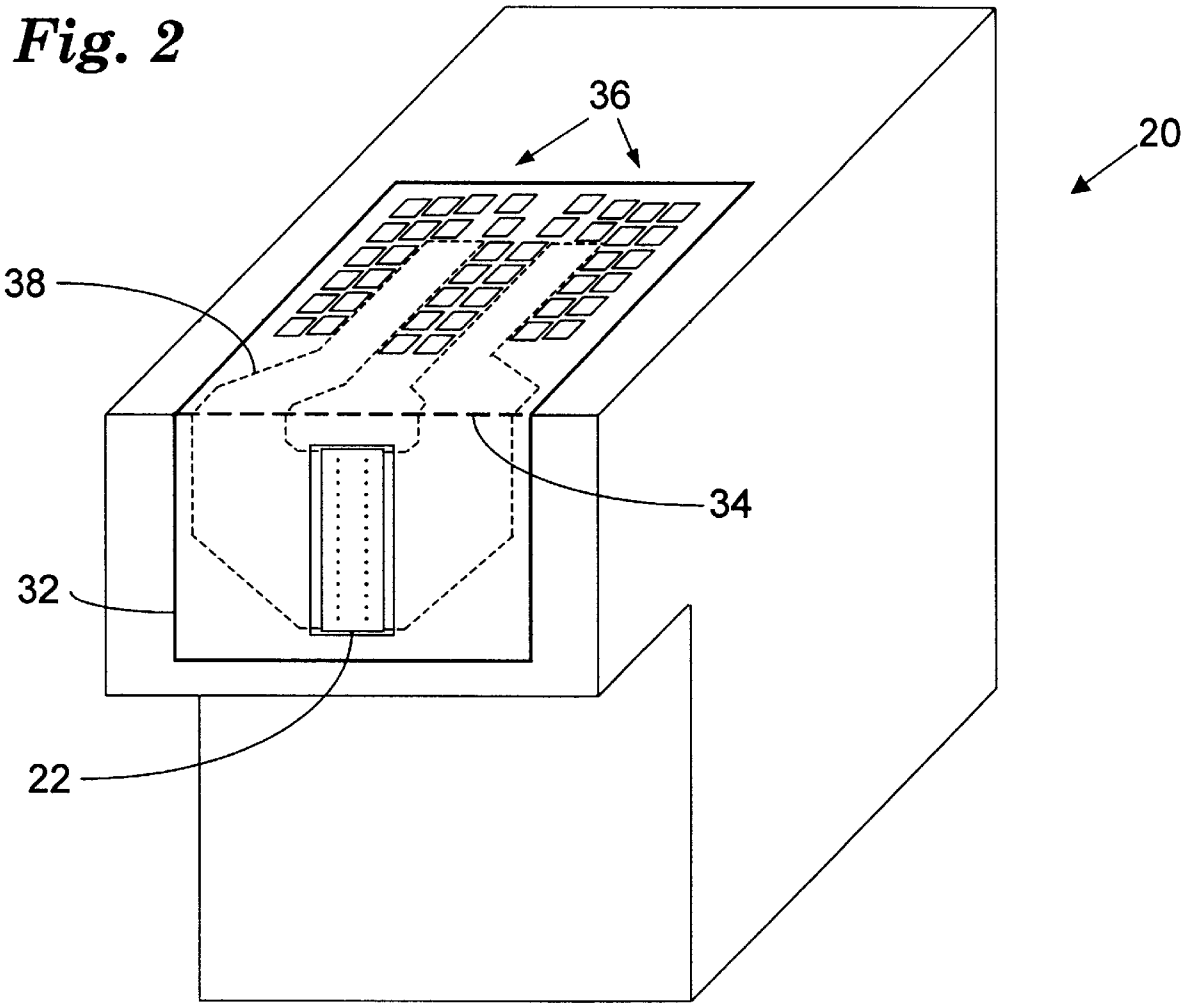
FIG. 2 depicts an ink jet print head according to a preferred embodiment of the invention.

As shown in FIGS. 1 and 2, the printer 10 includes a print head 20 that receives the print control signals from the printer controller 16. On the print head 20 is a thermal ink jet integrated circuit chip 22 covered by a nozzle plate. Within the nozzle plate are nozzles situated in a dual-columnar nozzle array. Based on the print control signals from the printer controller 16, ink droplets are ejected from selected nozzles to form dots on the print medium 14 corresponding to the pixels in the image 12. Ink is selectively ejected from a nozzle when a corresponding ink-heating resistor on the chip 22 is activated by the print control signals from the controller 16.

With reference to FIG. 1, the printer 10 includes a print head scanning mechanism 24 for scanning the print head 20 across the print medium 14 in a scanning direction as indicated by the arrow 26. Preferably, the print head scanning mechanism 24 consists of a carriage which slides horizontally on one or more rails, a belt attached to the carriage, and a motor that engages the belt to cause the carriage to move along the rails. The motor is driven in response to the scan commands generated by the printer controller 16.

The printer 10 also includes a print medium advance mechanism 28. Based on print medium advance commands generated by the controller 16, the print medium advance mechanism 28 causes the print medium 14 to advance in a paper advance direction, as indicated by the arrow 30, between consecutive scans of the print head 20. Thus, the image 12 is formed on the print medium 14 by printing multiple adjacent swaths as the print medium 14 is advanced in the advance direction between swaths. In a preferred embodiment of the invention, the print medium advance mechanism 28 is a stepper motor rotating a platen which is in contact with the print medium 14.

As shown in FIG. 1, the print control signals are preferably communicated to the print head 20 by way of three sets of control lines, Q, P, and A, included in a wiring harness 31. A first set of control lines (designated by Q) communicate q number of quad select signals, a second set of control lines (designated by A) communicate n number of address signals, and a third set of control lines (designated by P) communicate p number of primitive signals. As described in more detail herein, the values of q, n, and p, and the corresponding number of control lines in each set depends upon the selected performance/cost design point of the printer 10.

Attached to the print head 20 is a tape automated bonding (TAB) circuit 32, preferably formed on a flexible substrate of polyimide tape. The print head integrated circuit chip 22 is attached within a window of the TAB circuit 32. The flexible nature of the TAB circuit 32 provides for bending the TAB circuit 32 around a corner 34 of the print head 20, as shown in FIG. 2. Electrical connection between the TAB circuit 32 and the control lines Q, P, and A in the printer 10 is provided by a set of TAB contacts 36 on the TAB circuit 32. Electrical connection between the TAB contacts 36 and the chip 22 is provided by a set of conductors that are formed on the substrate material of the TAB circuit 32. The position of the conductors is represented in FIG. 2 by the dotted outline region 38. Generally, there is a separate conductor electrically connecting each TAB contact 36 to a corresponding contact on the chip 22. As described in more detail hereinafter, the number of these conductors on the TAB circuit 32 and in the wiring harness 31 depends upon the selected performance/cost design point of the printer 10.

Figure 3A:
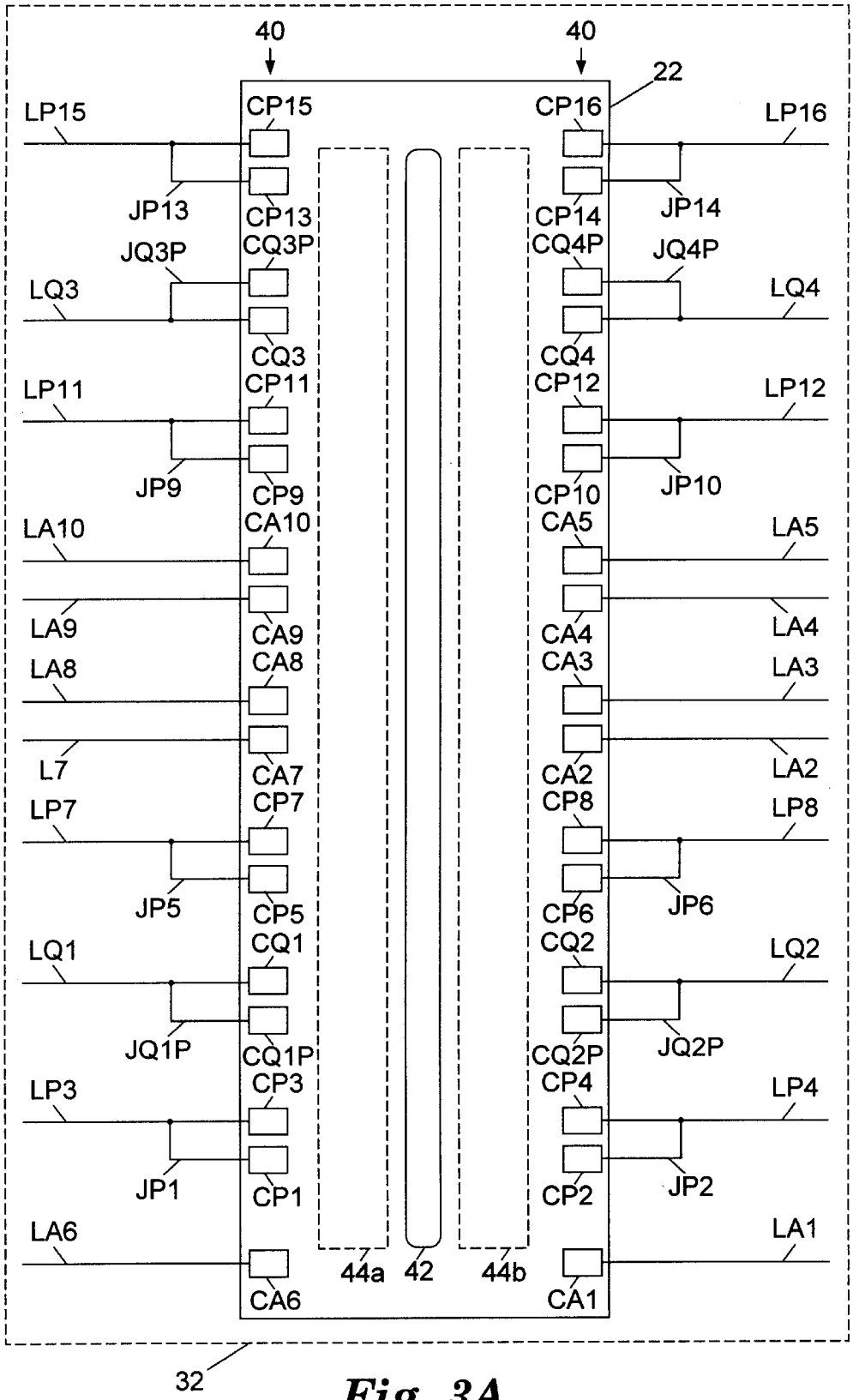
FIGS. 3A and 3B depict TAB circuit conductor configurations according to a preferred embodiment of the invention.
Figure 3B:
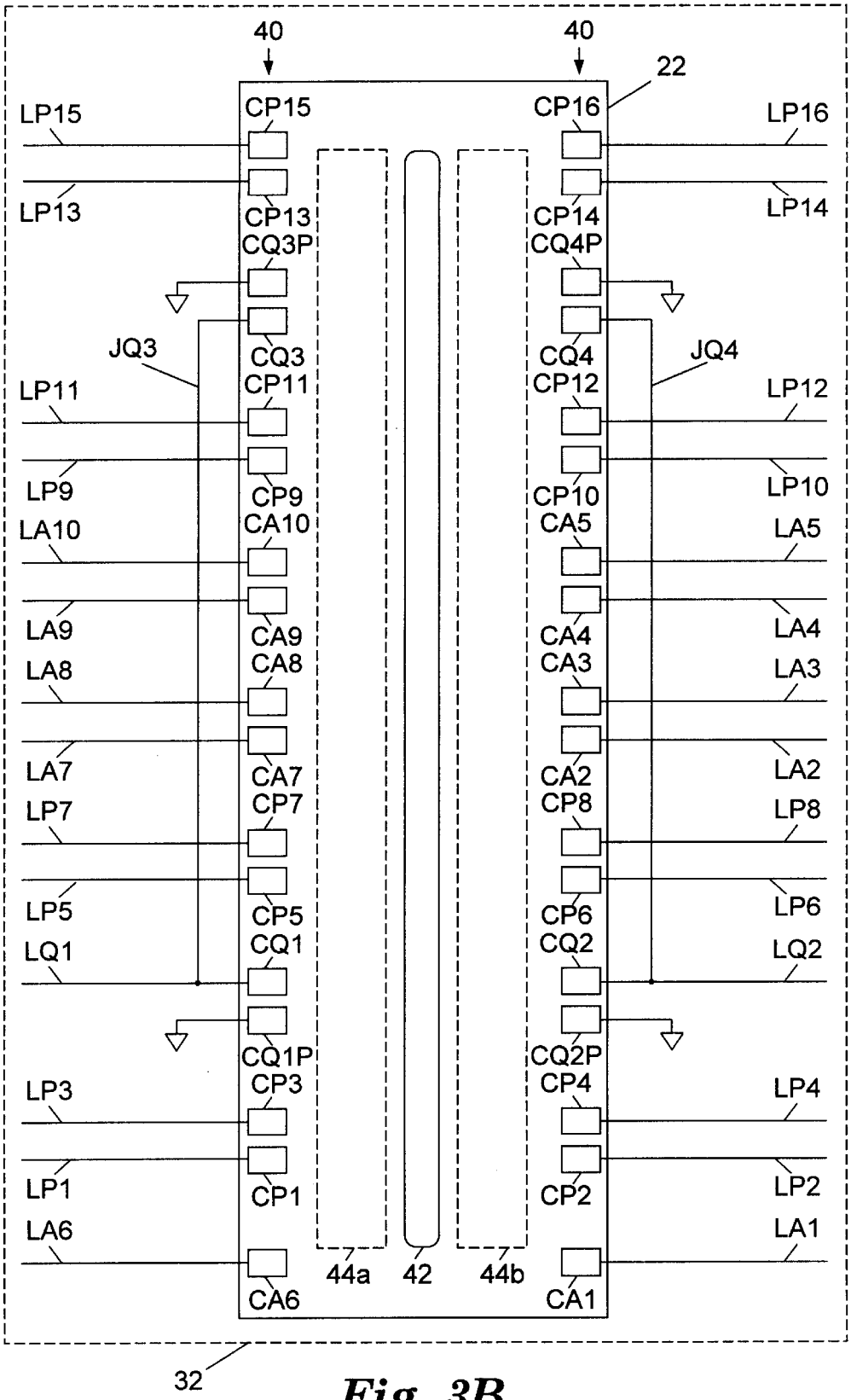

FIGS. 3A and 3B depict a preferred layout of the print head chip 22. Along the two longest edges of the chip 22 are electrical contacts 40 that provide connection points for the conductors on the TAB circuit 32. Preferably, these chip contacts 40 include $q_1$ number of first electrical contacts, also referred to herein as quad select contacts CQ1–CQ4, n number third electrical contacts, also referred to herein as of address contacts CA1–CA10, and $p_2$ number of second electrical contacts, also referred to herein as primitive contacts CP1–CP16. In the preferred embodiment of the invention, $q_1$ is four, n is ten, and $P_2$ is sixteen. Preferably, an ink via 42 is situated near the center of the chip 22. On either side of the ink via 42 are chip regions 44*a* and 44*b* in which are located the ink-heating resistors and selection logic devices.

FIG. 3A further depicts a configuration of conductors connected to the contacts 40 to implement a first operating mode of the printer 10, and the FIG. 3B further depicts a configuration of conductors connected to the contacts 40 to implement a second operating mode. These conductors on the TAB circuit 32 comprise an operating mode selection circuit, the configuration of which determines the operating mode in which the print head chip 22 will function and the performance/cost point of the printer 10. Possible configurations of these conductors, and their effect on the operation of the printer 10, are described in more detail hereinafter.

Figure 4A:
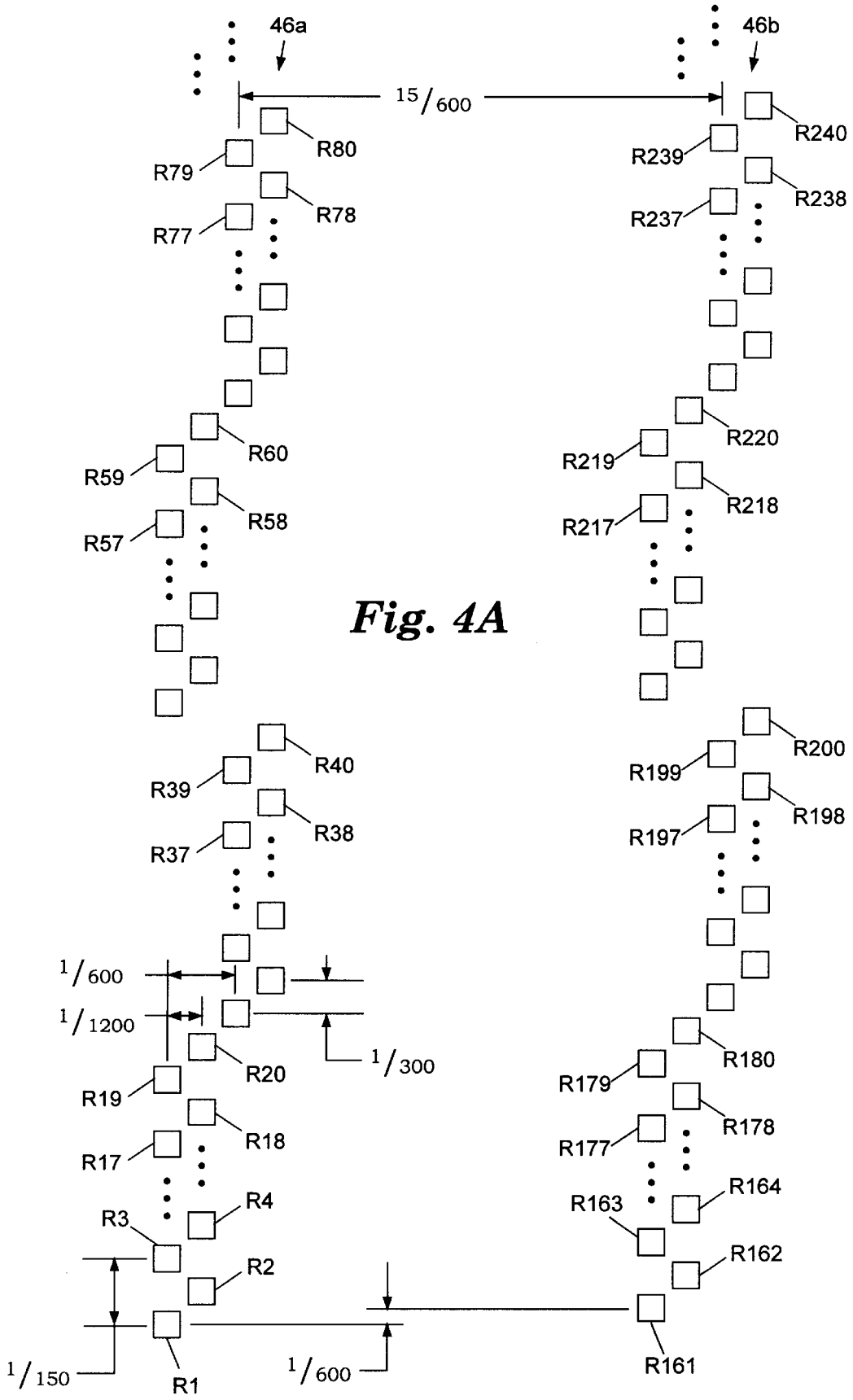
FIGS. 4A and 4B depict a configuration of ink-beating resistors on a print head chip according to a preferred embodiment of the invention.
Figure 4B:
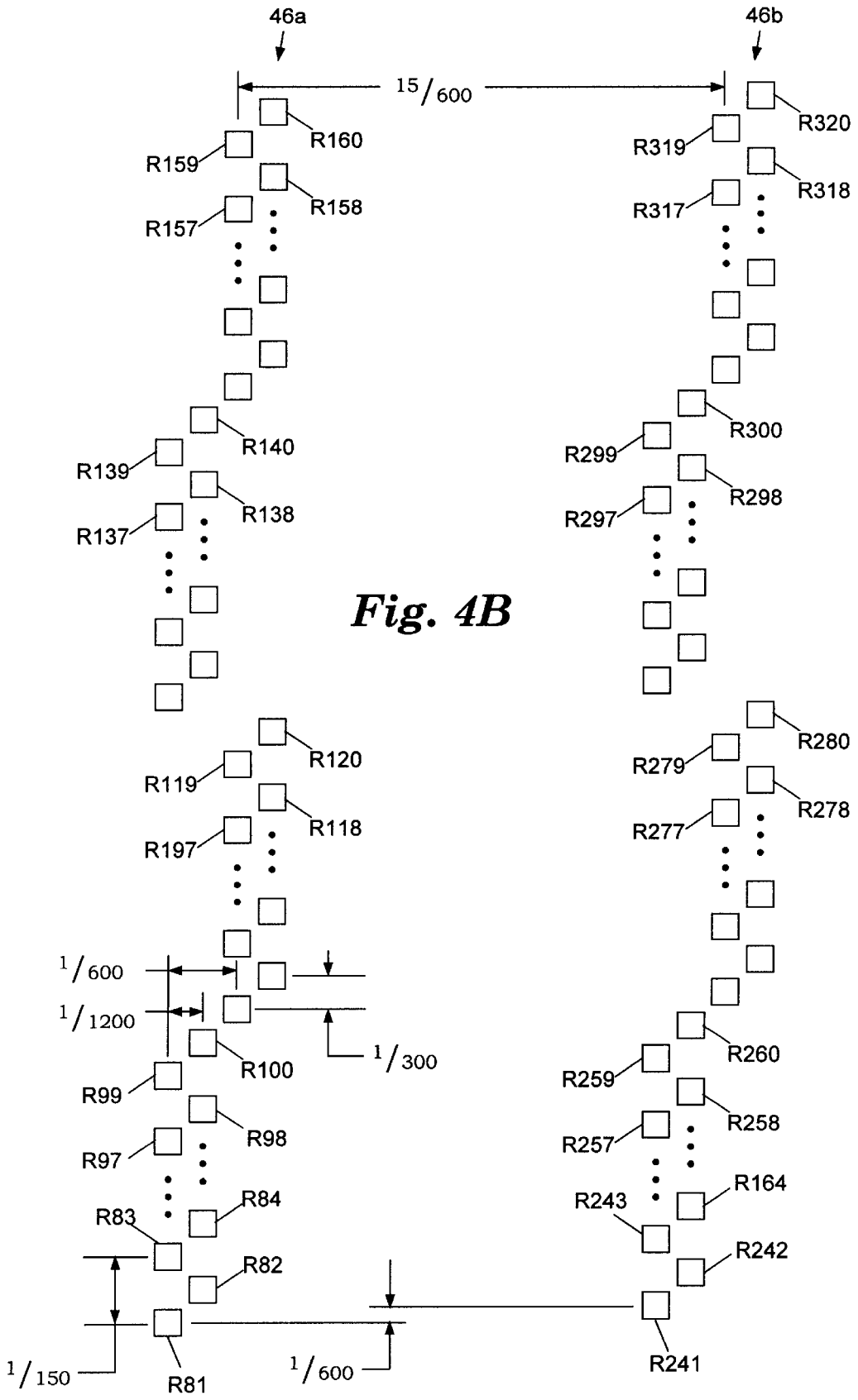

The preferred embodiment of the invention includes three-hundred-twenty (320) ink-heating resistors R1–R320. As depicted in FIG. 4, the resistors R1–R320 are preferably thin-film resistors arranged on the chip 22 in two main columns 46*a* and 46*b*, with each column 46*a* and 46*b* having eight sets of twenty resistors per set. FIG. 4A depicts the bottom half and FIG. 4B depicts the top half of the columns 46*a* and 46*b*. The column 46*a*, which includes the resistors R1–R160, is disposed within the region 44*a* (see FIGS. 3A–B), and the column 46*b*, which includes the resistors R161–R320, is disposed within the region 44*b*. Preferably, the column 46*a* is vertically offset from the column 46*b* by one-half the vertical spacing between resistors. In the preferred embodiment, this vertical offset is 1/600 inch.

The sixteen sets of resistors are each divided into two horizontally-separated sub-columns, with ten resistors in each sub-column. In the preferred embodiment, the horizontal offset between sub-columns within a set is 1/1200 inch. Preferably, the ten resistors within each sub-column are vertically aligned and separated by 1/150 inch. As shown in FIGS. 4A and 4B, the two sub-columns within each set are vertically offset from one another by one-half the spacing between heaters within a sub-column. In the preferred embodiment, this vertical offset is 1/300 inch.

Preferably, vertically-adjacent sets are horizontally offset from one another by twice the horizontal spacing between sub-columns. In the preferred embodiment, this horizontal offset is 1/600 inch. Thus, as shown in FIGS. 4A and 4B, alternating sets within each column 46*a* and 46*b* are vertically aligned.

FIGS. 5A–5H collectively depict a schematic diagram of the preferred embodiment of circuitry on the print head chip 22. This circuitry includes the ink-heating resistors R1–R320 and switching circuits which provide for selection and activation of individual resistors R1–R320 based on the quad select signals on the quad select signal lines Q1–Q4, address signals on the address signal lines A1–A10, and primitive signals on the primitive signal lines P1–P16. The switching circuits include first, second, and third switching devices, also referred to herein as pass-gate devices PG1–PG320, power driver devices D1–D320, and pull-down devices PD1–PD320, respectively. Preferably, the pass-gate devices PG1–PG320 and the pull-down devices PD1–PD320 are JFETs, and the power driver devices D1–D320 are NMOS power transistors.

Each of the ink-heating resistors R1–R320 has a high side that is connected to one of the primitive signal lines P1–P16 and a low side that is connected to a second high-side input, preferably the drain, of an associated one of the power driver devices D1–D320. Each of the power driver devices D1–D320 has a second low-side output, preferably the source, which is connected to a common ground return. The gate of each of the power driver devices D1–D320 serves as a second control input. In the preferred embodiment, when a control signal on the gate of a power driver D1–D320 is high, the power driver D1–D320 is "on", acting like a closed switch. Thus, when a power driver D1–D320 is "on", the low side of the associated ink-heating resistor R1–R320 is grounded. When the primitive signal goes high on the associated one of the primitive signal lines P1–P16 while the associated power driver D1–D320 is "on", current flows through the associated ink-heating resistor R1–R320. This current causes the resistor R1–R320 to dissipate energy in the form of heat that is transferred to ink that is adjacent the surface of the resistor R1–R320.

Whether the gate of a power driver D1–D320 is high, and thus whether the power driver D1–D320 is "on", depends on the states of the quad select signal on the associated quad select signal line Q1–Q4 and the address signal on the associated address signal line A1–A10. As shown in FIGS. 5A–5H, one of the quad select signal lines Q1–Q4 is connected to a first control input, preferably the gate, of each of the pass-gate devices PG1–PG320. When the quad select signal on the gate is high, the pass-gate device PG1–PG320 is "on" and thus acts like a closed switch. One of the address lines A1–A10 is connected to a first high-side input, preferably the drain, of each of the pass-gate devices PG1–PG320. The pass-gate devices PG1–PG320 each have a first low-side output, preferably the source, that is connected to the gate of the associated power driver D1–D320. When a pass-gate device PG1–PG320 is "on" (quad select signal is high), the address signal on the drain of the pass-gate device PG1–PG320 passes to the gate of the associated power driver D1–D320. Therefore, in the preferred embodiment, when the quad select signal at the gate and the address signal at the drain of a pass-gate device PG1–PG320 are both high, the associated power driver D1–D320 is "on".

As shown in FIGS. 5A–5H, associated with each power driver D1–D320 is a pull-down device PD1–PD320. The high-side input, preferably the drain, of each pull-down device PD1–PD320 is connected to the gate of a corresponding power driver D1–D320, and the low-side output, preferably the source, of each pull-down device PD1–PD320 is connected to the common ground return. Thus, when a pull-down device PD1–PD320 is "on", the gate of the corresponding power driver D1–D320 is grounded. Therefore, when a pull-down device PD1–PD320 is "on", the corresponding power driver D1–D320 is "off". The purpose and function of the pull-down devices PD1–PD320 according to one of the operational modes of the print head chip 22 is described in more detail hereinafter.

Figure 5A:
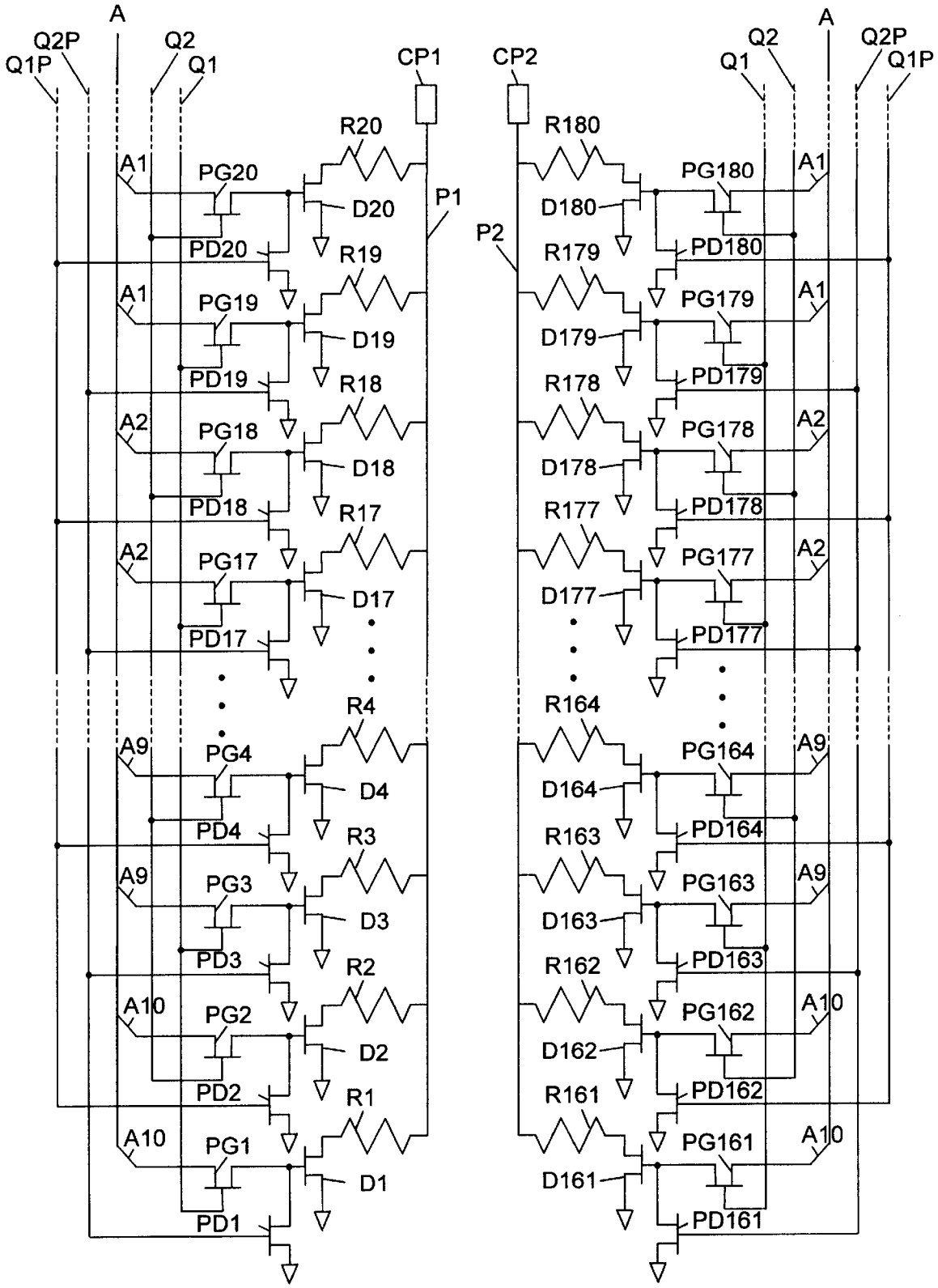
FIGS. 5A–5H are schematic diagrams that collectively show ink-heating resistors and resistor selection circuitry on a print head chip according to a preferred embodiment of the invention.

As shown in FIG. 5A, the resistors R1–R20 are connected to the primitive line P1, and the resistors R161–R180 are connected to the primitive line P2. For convenience of discussion, all of the devices that are connected to the primitive line P1 are referred to as a first primitive group, and all of the devices that are connected to the primitive line P2 are referred to as a second primitive group. The primitive lines P1 and P2 are connected to the primitive contacts CP1 and CP2, respectively.

The gates of the odd-numbered pass-gate devices PG1–PG19 and PG161–PG179 are connected to the quad select line Q1, and the gates of the even-numbered pass-gate devices PG2–PG20 and PG162–PG180 are connected to the quad select line Q2. For convenience of discussion, all of the devices that are connected to the quad select line Q1 are referred to as a first quad group, and all of the devices that are connected to the quad select line Q2 are referred to as a second quad group.

The gates of the odd-numbered pull-down devices PD1–PG19 and PD161–PG179 are connected to the pull-down signal line Q2P, and the gates of the even-numbered pull-down devices PD2–PD20 and PD162–PD180 are connected to the pull-down signal line Q1P.

Figure 5B:
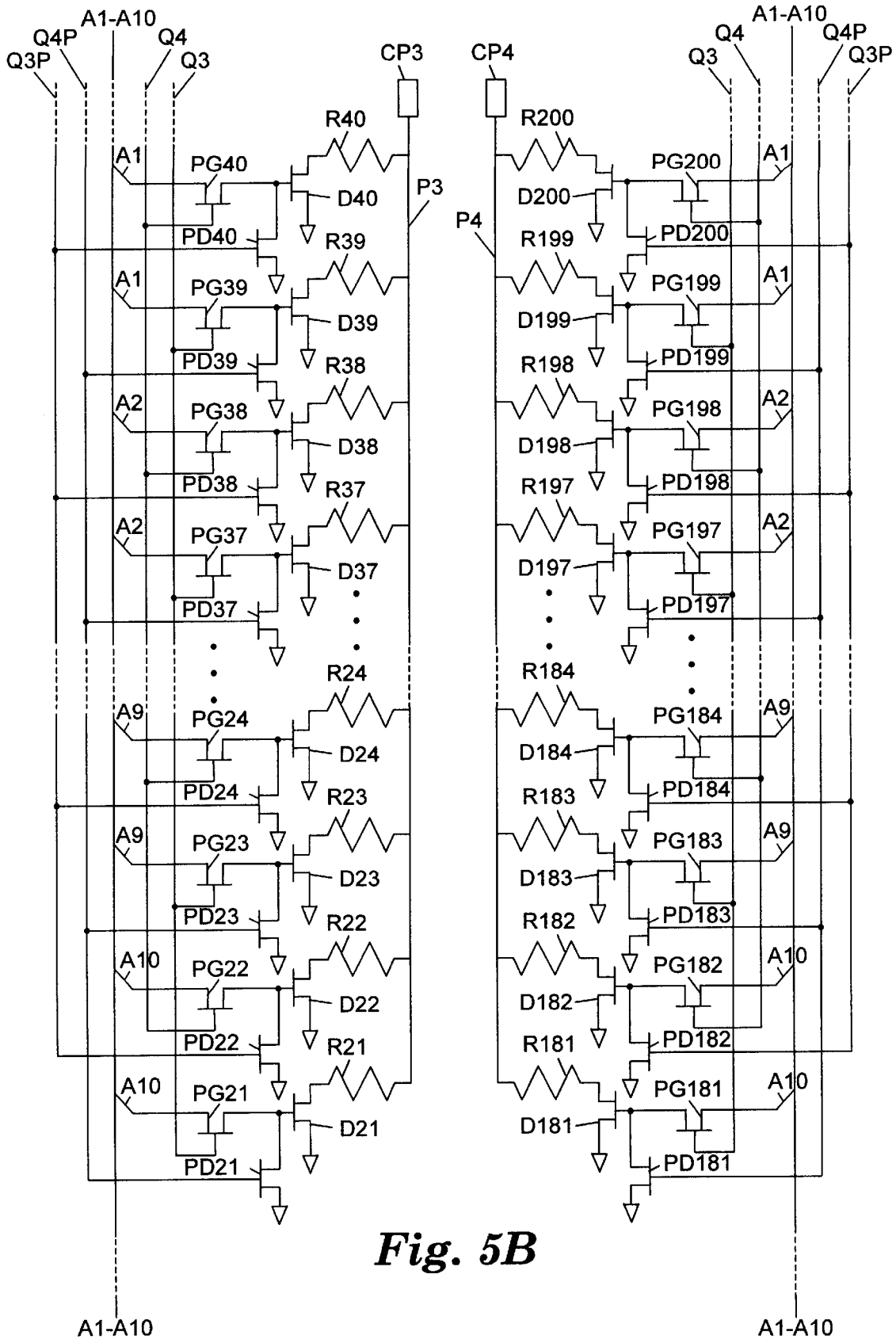
Figure 5C:
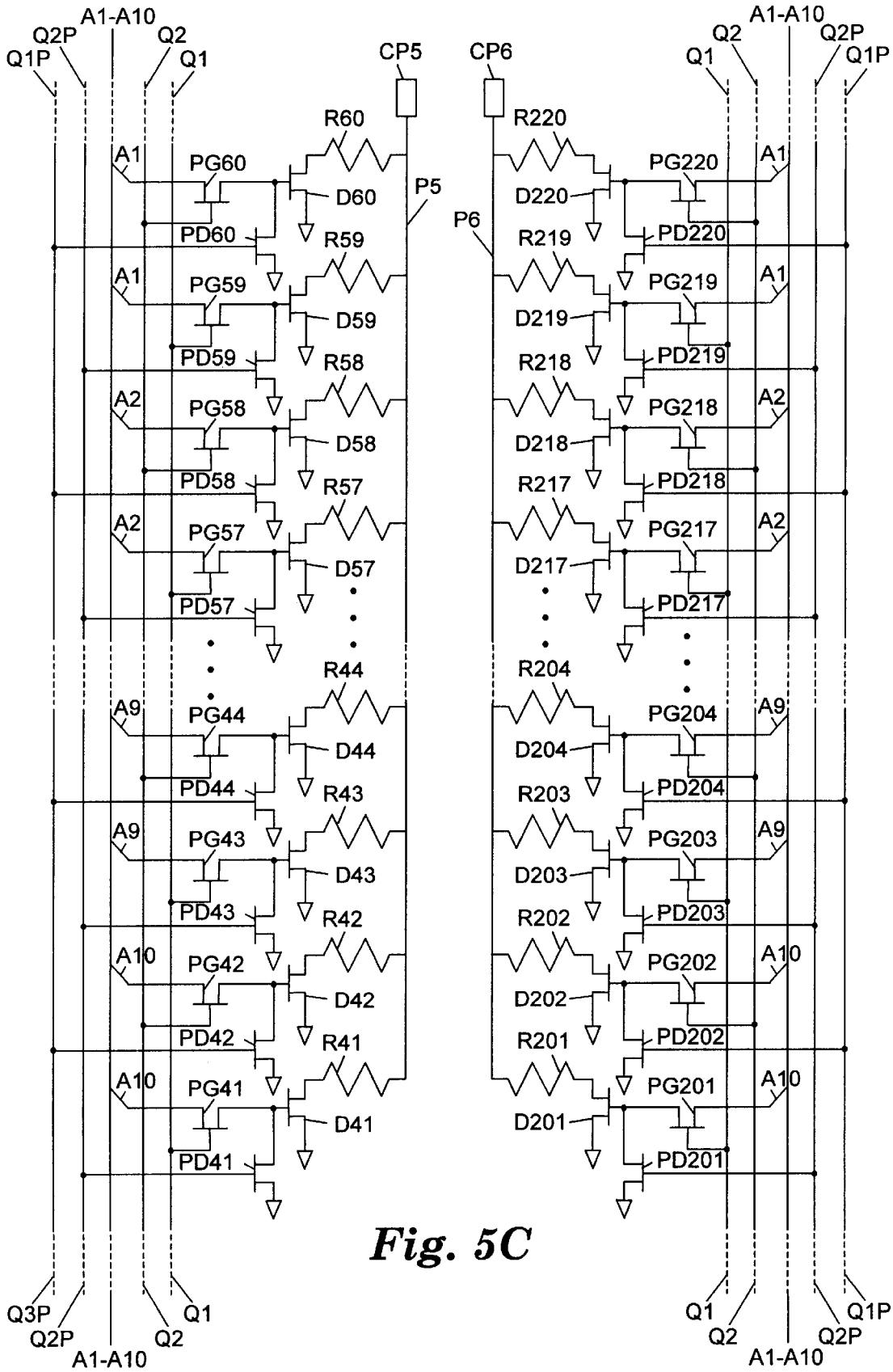
Figure 5D:
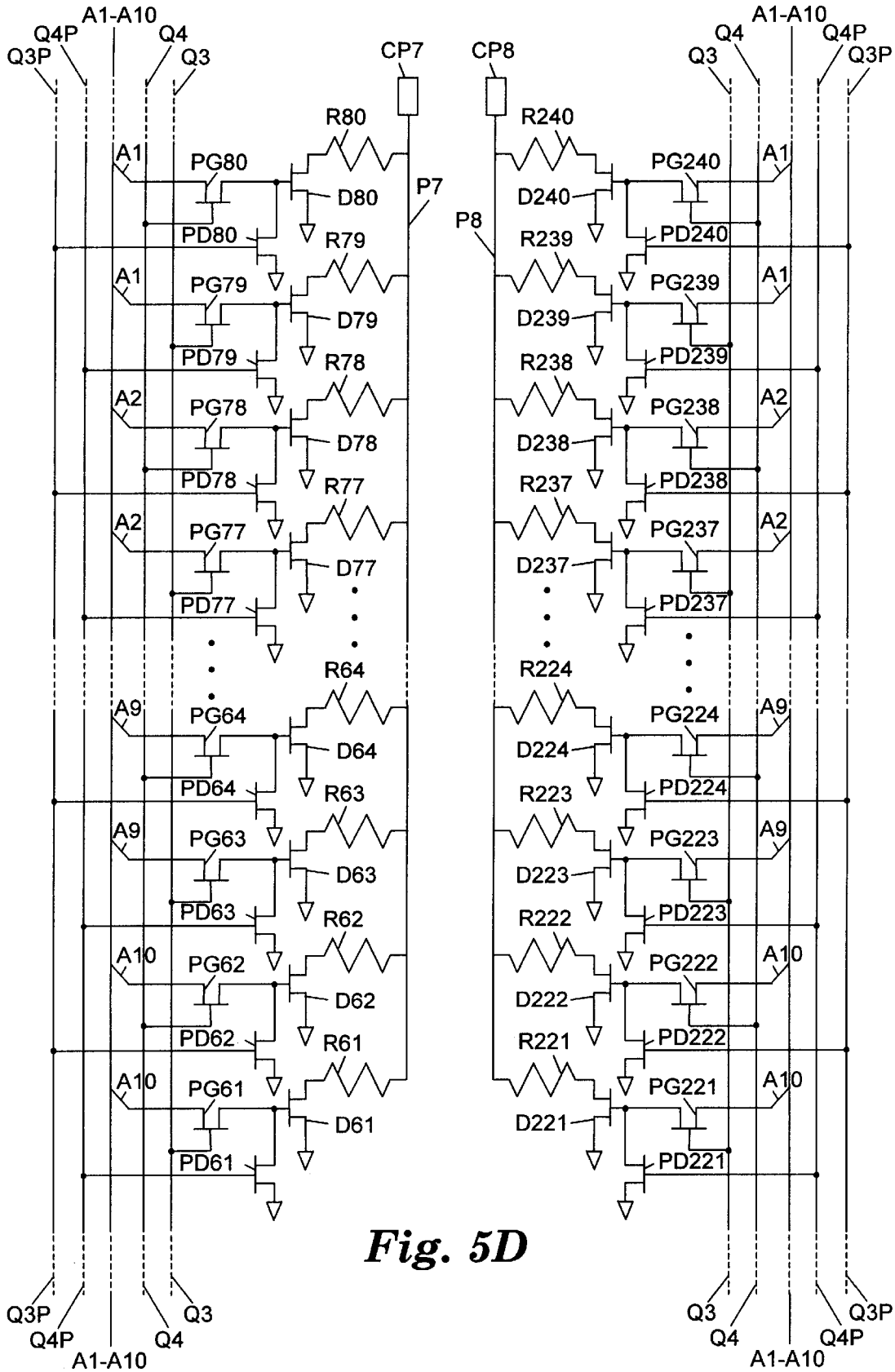
Figure 5E:
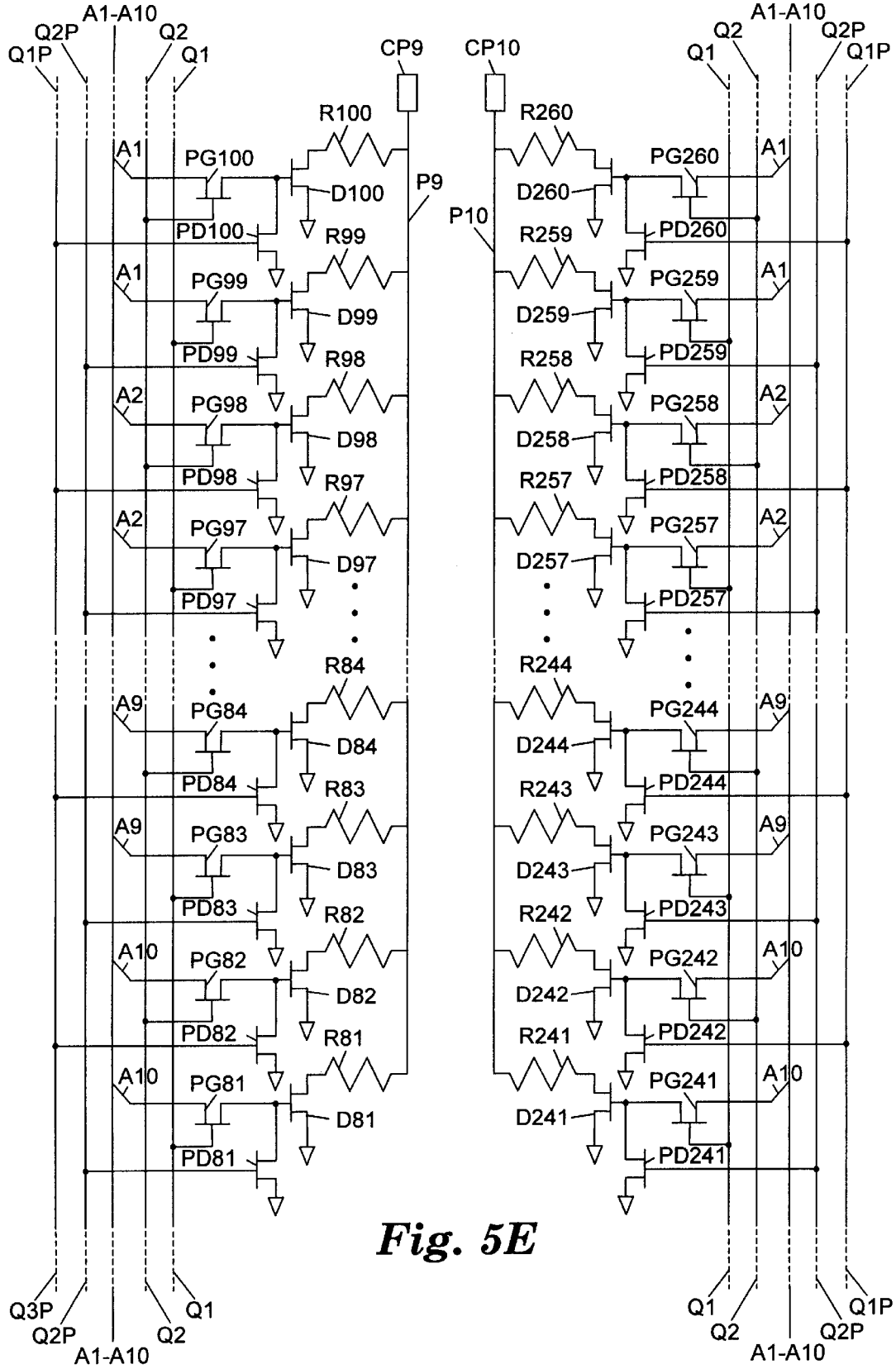
Figure 5F:
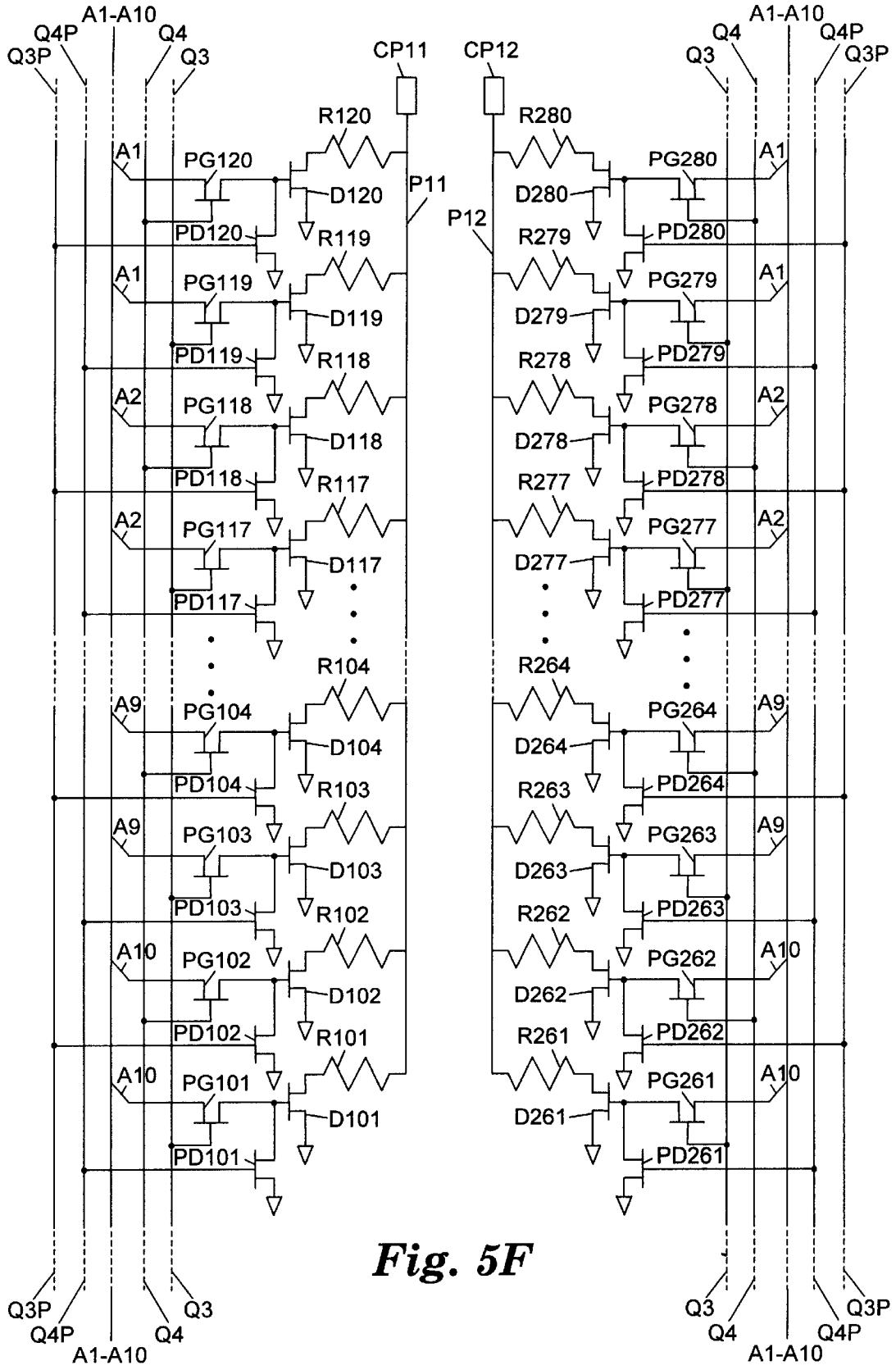

As shown in FIG. 5B, the resistors R21–R40 are connected to the primitive line P3, and the resistors R181–R200 are connected to the primitive line P4. For convenience of discussion, all of the devices that are connected to the primitive line P3 are referred to as a third primitive group, and all of the devices that are connected to the primitive line P4 are referred to as a fourth primitive group. The primitive lines P3 and P4 are connected to the primitive contacts CP3 and CP4, respectively.

The gates of the odd-numbered pass-gate devices PG21–PG39 and PG181–PG199 are connected to the quad select line Q3, and the gates of the even-numbered pass-gate devices PG22–PG40 and PG182–PG200 are connected to the quad select line Q4. For convenience of discussion, all of the devices that are connected to the quad select line Q3 are referred to as a third quad group, and all of the devices that are connected to the quad select line Q4 are referred to as a fourth quad group.

The gates of the odd-numbered pull-down devices PD21–PG39 and PD181–PG199 are connected to the pull-down signal line Q4P, and the gates of the even-numbered pull-down devices PD22–PD40 and PD182–PD200 are connected to the pull-down signal line Q3P.

Preferably, each of the ten address lines A1–A10 in the address bus A is connected to the drain of one odd-numbered and one even-numbered pass-gate device in each primitive group.

Figure 5G:
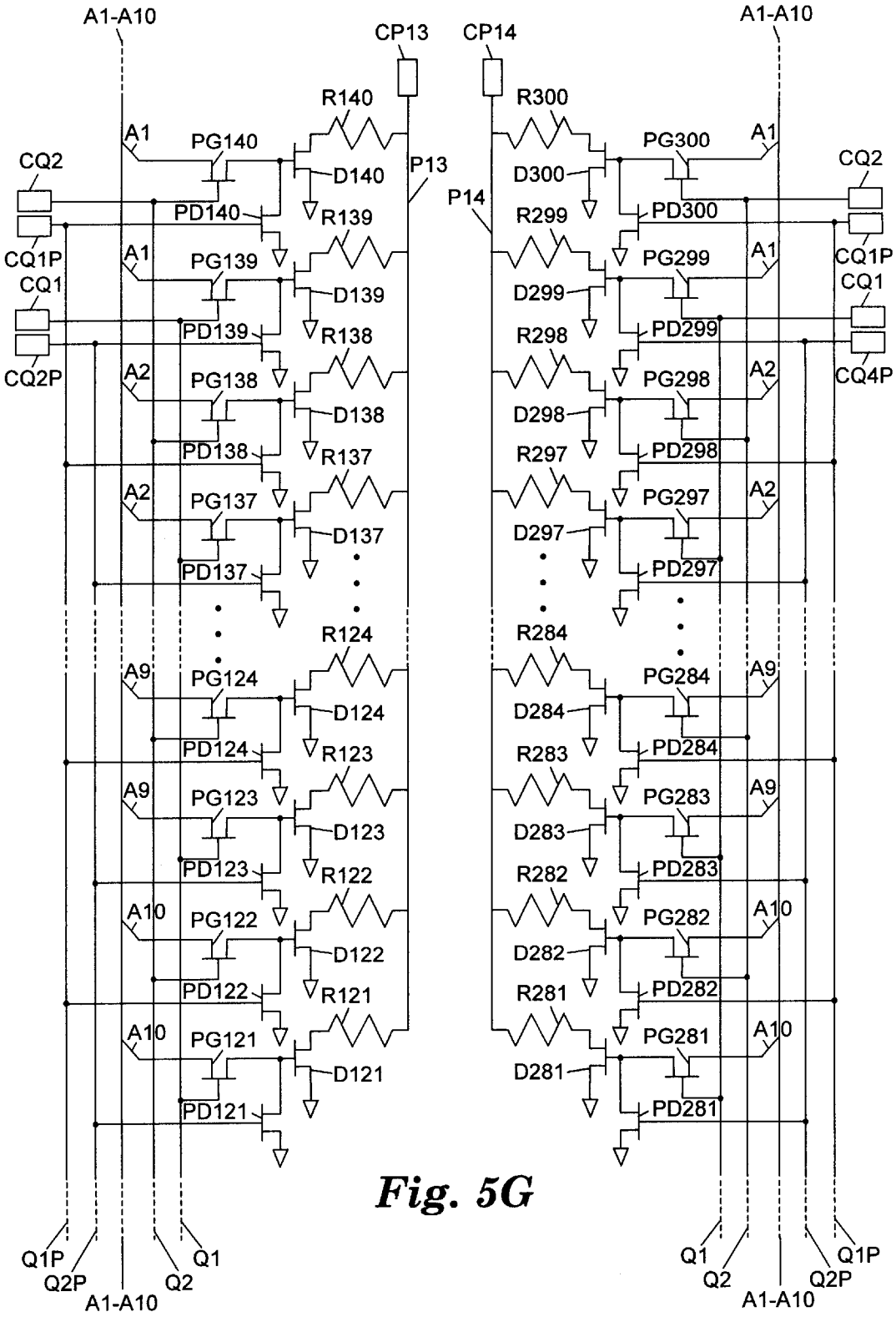
Figure 5H:
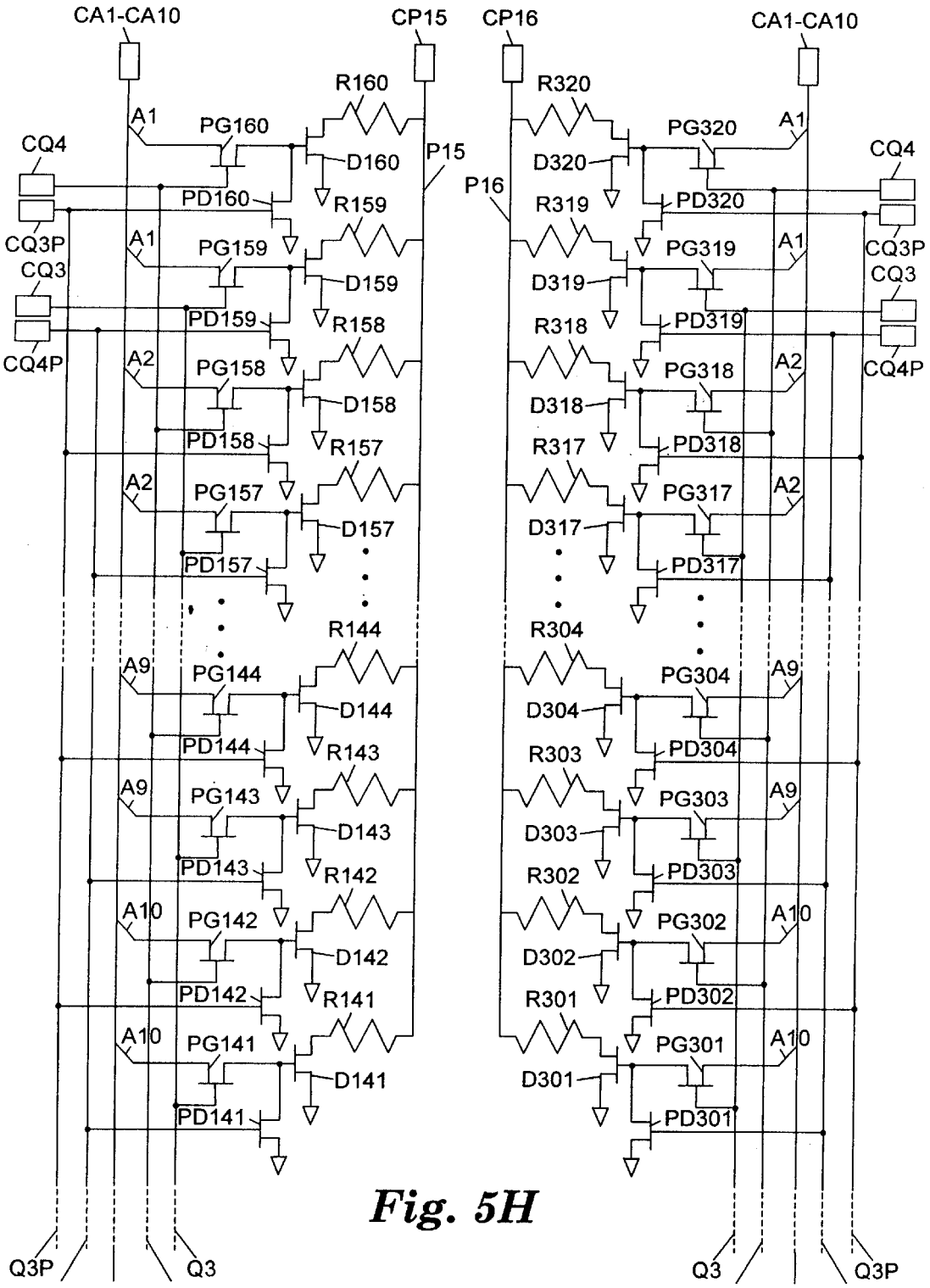

The pattern of device connections shown in FIGS. 5A and 5B, and described above, continue for the remaining primitive groups, as depicted in FIGS. 5C–5H. For each of the remaining primitive groups, the primitive lines P5–P16 are connected to the primitive contacts CP5–CP16, respectively. As shown in FIGS. 5G and 5H, the quad select signal lines Q1–Q4 are connected to the quad select contacts CQ1–CQ4, the pull-down signal lines Q1P–Q4P are connected to the pull-down contacts CQ1P–CQ4P, and the address signal lines A1–A10 are connected to the address contacts CA1–CA10.

Tables I, II, III, and IV below correlate resistor numbers to quad select, primitive, and address signal lines.

TABLE I

| | Q1 | | | | | | | | | |
|---|---|---|---|---|---|---|---|---|---|---|
| | A1 | A2 | A3 | A4 | A5 | A6 | A7 | A8 | A9 | A10 |
| P1 | R1 | R15 | R9 | R3 | R17 | R11 | R5 | R19 | R13 | R7 |
| P2 | R161 | R175 | R169 | R163 | R177 | R171 | R165 | R179 | R173 | R167 |
| P5 | R41 | R55 | R49 | R43 | R57 | R51 | R45 | R59 | R53 | R47 |
| P6 | R201 | R215 | R209 | R203 | R217 | R211 | R205 | R219 | R213 | R207 |
| P9 | R81 | R95 | R89 | R83 | R97 | R91 | R85 | R99 | R93 | R87 |
| P10 | R241 | R255 | R249 | R243 | R257 | R251 | R245 | R259 | R253 | R247 |
| P13 | R121 | R135 | R129 | R123 | R137 | R131 | R125 | R139 | R133 | R127 |
| P14 | R281 | R295 | R289 | R283 | R297 | R291 | R285 | R299 | R293 | R287 |

TABLE II

| | Q2 | | | | | | | | | |
|---|---|---|---|---|---|---|---|---|---|---|
| | A1 | A2 | A3 | A4 | A5 | A6 | A7 | A8 | A9 | A10 |
| P1 | R2 | R16 | R10 | R4 | R18 | R12 | R6 | R20 | R14 | R8 |
| P2 | R162 | R176 | R170 | R164 | R178 | R172 | R166 | R180 | R174 | R168 |
| P5 | R42 | R56 | R50 | R44 | R58 | R52 | R46 | R60 | R54 | R48 |
| P6 | R202 | R216 | R210 | R204 | R218 | R212 | R206 | R220 | R214 | R208 |
| P9 | R82 | R96 | R90 | R84 | R98 | R92 | R86 | R100 | R94 | R88 |
| P10 | R242 | R256 | R250 | R244 | R258 | R252 | R246 | R260 | R254 | R248 |
| P13 | R122 | R136 | R130 | R124 | R138 | R132 | R126 | R140 | R134 | R128 |
| P14 | R282 | R296 | R290 | R284 | R298 | R292 | R286 | R300 | R294 | R288 |

TABLE III

| | Q3 | | | | | | | | | |
|---|---|---|---|---|---|---|---|---|---|---|
| | A1 | A2 | A3 | A4 | A5 | A6 | A7 | A8 | A9 | A10 |
| P3 | R22 | R35 | R29 | R23 | R37 | R31 | R25 | R39 | R33 | R27 |
| P4 | R181 | R195 | R189 | R183 | R197 | R191 | R185 | R199 | R193 | R187 |
| P7 | R61 | R75 | R69 | R63 | R77 | R71 | R65 | R79 | R73 | R67 |
| P8 | R221 | R235 | R229 | R223 | R237 | R231 | R225 | R239 | R233 | R227 |
| P11 | R101 | R115 | R109 | R103 | R117 | R111 | R105 | R119 | R113 | R107 |
| P12 | R261 | R275 | R269 | R263 | R277 | R271 | R265 | R279 | R273 | R267 |
| P15 | R141 | R155 | R149 | R143 | R157 | R151 | R145 | R159 | R153 | R147 |
| P16 | R301 | R315 | R309 | R303 | R317 | R311 | R305 | R319 | R313 | R307 |

TABLE IV

| | Q4 | | | | | | | | | |
|---|---|---|---|---|---|---|---|---|---|---|
| | A1 | A2 | A3 | A4 | A5 | A6 | A7 | A8 | A9 | A10 |
| P3 | R22 | R36 | R30 | R24 | R38 | R32 | R26 | R40 | R34 | R28 |
| P4 | R182 | R196 | R190 | R184 | R198 | R192 | R186 | R200 | R194 | R188 |
| P7 | R62 | R76 | R70 | R64 | R78 | R72 | R66 | R80 | R74 | R68 |
| P8 | R222 | R236 | R230 | R224 | R238 | R232 | R226 | R240 | R234 | R228 |
| P11 | R102 | R116 | R110 | R104 | R118 | R112 | R106 | R120 | R114 | R108 |
| P12 | R262 | R276 | R270 | R264 | R278 | R272 | R266 | R280 | R274 | R268 |
| P15 | R142 | R156 | R150 | R144 | R158 | R152 | R146 | R160 | R154 | R148 |
| P16 | R302 | R316 | R310 | R304 | R318 | R312 | R306 | R320 | R314 | R308 |

As indicated by FIGS. 5A–5H, each of the sixteen ($P_2$) primitive groups of twenty ($q_2 \times n = 2 \times 10$) ink-heating resistors is connected to a distinct one of the sixteen primitive lines LP1–LP16, which are brought out to sixteen corresponding primitive contacts CP1–CP16 on the chip 22. Thus, each of the sixteen primitive groups on the chip 22 is independently addressable by a primitive signal from the printer controller 16. Similarly, each of the four ($q_1$) quad select groups of eighty ($p_1 \times n = 8 \times 10$) ink-heating resistors is connected to a distinct one of the four quad select lines LQ1–LQ4, which are brought out to four corresponding quad select contacts CQ1–CQ4 on the chip 22. Therefore, each of the four quad select groups on the chip 22 is independently addressable by a quad select signal from the printer controller 16. In other words, each primitive group on the chip 22 may be addressed independently of any other primitive group, and each quad select group may be addressed independently of any other quad select group.

One skilled in the art will appreciate, that the chip 22 provides more independently-addressable primitive groups and quad select groups than are necessary to address 320 resistors. In fact, 640 resistors could be addressed with the sixteen primitive lines, four quad select lines, and ten address lines provided on the chip 22. However, as described in greater detail below, these extra signal lines are provided so that the printer 10 may be manufactured to operate at either one of two different cost/performance design points using a single print head chip design.

Referring again to FIG. 3A, a first configuration of conductors on the TAB circuit 32 is shown for selecting the first operating mode of the print head chip 22. In this first configuration, quad select conductors LQ1, LQ2, LQ3, and LQ4 on the TAB circuit 32 are connected to the corresponding quad select contacts CQ1, CQ2, CQ3, and CQ4 on the chip 22, primitive conductors LP3, LP4, LP7, LP8, LP11, LP12, LP15, and LP16 on the TAB circuit 32 are connected to the corresponding primitive contacts CP3, CP4, CP7, CP8, CP11, CP12, CP15, and CP16 on the chip 22, and address conductors LA1–LA10 on the TAB circuit 32 are connected to the corresponding address contacts CA1–CA10 on the chip 22. Pull-down jumper conductors JQ1P, JQ2P, JQ3P, and JQ4P on the TAB circuit 32 short the quad select conductors LQ1, LQ2, LQ3, and LQ4 to the corresponding pull-down contacts CQ1P, CQ2P, CQ3P, and CQ4P on the chip 22. Primitive jumper conductors JP1, JP2, JP5, JP6, JP9, JP10, JP13, and JP14 on the TAB circuit 32 short the primitive contacts CP1, CP2, CP5, CP6, CP9, CP10, CP13, and CP14 to the primitive conductors LP3, LP4, LP7, LP8, LP11, LP12, LP15, and LP16, respectively.

Thus, the configuration of TAB circuit conductors shown in FIG. 3A shorts primitive signal lines P1 to P3, P2 to P4, P5 to P7, P6 to P8, P9 to P11, P10 to P12, P13 to P15, and P14 to P16. In this manner, the number of independently-addressable primitive groups is reduced from sixteen to eight, with forty ($q_1 \times n = 4 \times 10$) of the ink-heating resistors R1–R320 in each of the eight primitive groups. This provides an addressing scheme of eight primitive signals ($p = p_1 = 8$), four quad select signals ($q = q_1 = 4$), and ten address signals ($n = 10$), for a total of twenty-two control signals that must be communicated from the printer controller 16 to the chip 22. Thus, in the first implementation of the TAB circuit 32, only twenty-two control signal conductors are needed in the wiring harness 31 and only twenty-two control signal contacts 36 are needed on the TAB circuit 32. Therefore, this first implementation significantly reduces the cost of the printer 10.

Figure 6A:
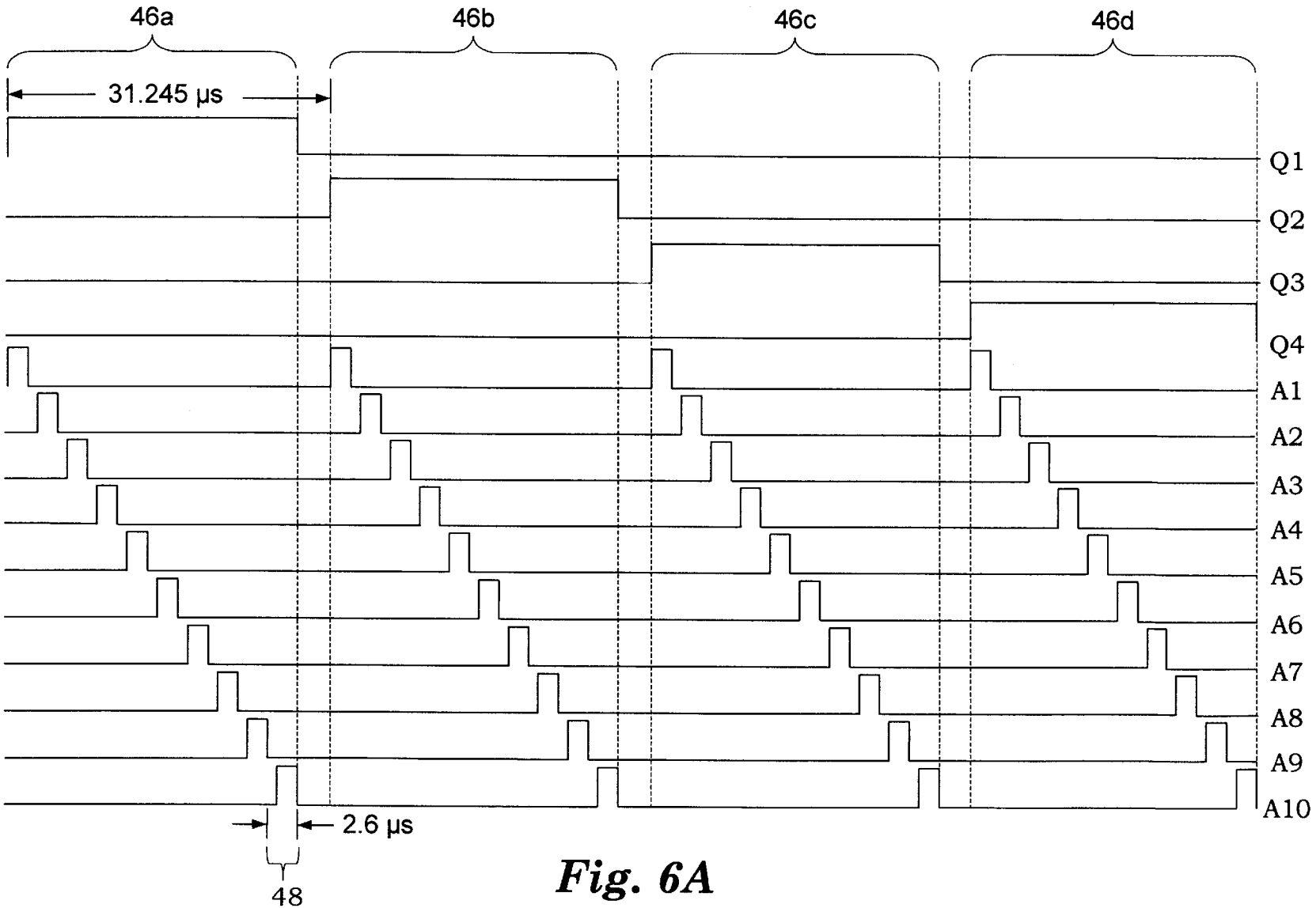
FIGS. 6A and 6B depict control signal timing diagrams according to a preferred embodiment of the invention.

FIG. 6A is a timing diagram depicting the preferred signal timing scheme when the print head chip 22 is addressed in the first operating mode. As shown in FIG. 6A, the quad select signals on the quad select lines Q1–Q4 are high during sequential quad select windows 46*a*–46*d*. Preferably, each quad select window 46*a*–46*d* endures for approximately 31.245 μs. During each quad select window 46*a*–46*d*, each of the address signals on the address lines A1–A10 go high within sequential address windows 48 of approximately 2.6 μs duration. During any address window 48, the printer controller 16 may drive any or all of the primitive signals high on the eight primitive lines P1, P2, P5, P6, P9, P10, P13, and P14 as determined by the image data. Thus, in this first operating mode, there are forty ($q1 \times n = 4 \times 10$) groups of resistors that are enabled sequentially as the print head 20 scans across the print medium 14, and the eight ($p_1 = 8$) resistors in any one of these forty groups may be activated simultaneously when the group is enabled.

Since the quad select signal conductor LQ1 on the TAB circuit 32 is shorted to the pull-down contact CQ1P, the gates of all of the even-numbered pull-down devices PD2–PD20 and PD162–PD180 are high during the quad select window 46*a*. Thus, the power drivers PD2–PD20 and PD162–PD180 in the second quad group are "off" during the quad select window 46*a*. Also, since the quad select signal conductor LQ2 on the TAB circuit 32 is shorted to the pull-down contact CQ2P, the gates of all of the odd-numbered pull-down devices PD1–PD19 and PD161–PD179 are high during the quad select window 46*b*. Thus, the power drivers PD1–PD19 and PD161–PD179 in the first quad group are "off" during the quad select window 46*b*. Although not shown in the schematic, Q1 and Q2 may be connected to additional pull down devices such that the power devices PD21–PD40 and PD181–PD200 are "off" during quad select windows 46*a* and 46*b*. Similarly, because the quad select signal conductor LQ3 is shorted to the pull-down contact CQ3P, the gates of all of the even-numbered pull-down devices PD22–PD40 and PD182–PD200 are high during the quad select window 46*c*. Thus, the power drivers PD22–PD40 and PD182–PD200 in the third quad group are "off" during the quad select window 46*c*. Further, since the quad select signal conductor LQ4 is shorted to the pull-down contact CQ4P, the gates of all of the odd-numbered pull-down devices PD21–PD39 and PD181–PD199 are high during the quad select window 46*d*. Thus, the power drivers PD21–PD39 and PD181–PD199 in the fourth quad group are "off" during the quad select window 46*d*. Although not shown in the schematic, Q3 and Q4 may be connected to additional pull down devices such that the power devices PD1–PD20 and PD161–PD180 are "off" during quad select windows 46*c* and 46*d*.

The signal transitions shown in FIG. 6A occur as the print head scanning mechanism 24 scans the print head 20 across the print medium 14 from right to left. As the print head 20 scans from left to right, the order of the quad select window transitions is reversed: first Q4 is high, then Q3, Q2, and Q1. In the preferred embodiment of the invention, the scan speed of the print head 20 in the first operating mode is approximately 26.67 inch/second. Thus, during one address window 48, the print head 20 travels approximately $6.93 \times 10^{-5}$ inch in the scan direction. During one quad select window 46*a*–46*d*, the print head 20 travels approximately $8.33 \times 10^{-4}$ (1/1200) inch. This means that the print head 20 travels 4/1200 (1/300) inch during the time required to address all of the resistors R1–R320.

Preferably, in the first operating mode, the ink droplets are deposited on the print medium 14 in a checkerboard pattern to allow for the fastest possible drying of the ink. Preferably, the invention uses two ink droplets to fill a 1/600 inch diameter spot on the print medium 14. This is referred to as a four-pass implementation, since four passes of the print head 20 across the print medium 14 are required to fill all possible print positions in a print swath.

Shown in FIG. 3B is a second configuration of conductors on the TAB circuit 32 for implementing the second operating mode of the print head chip 22. In this second configuration, the quad select conductors LQ1 and LQ2 on the TAB circuit 32 are connected to the corresponding quad select contacts CQ1 and CQ2 on the chip 22, the primitive conductors LP1–LP16 on the TAB circuit 32 are connected to the corresponding primitive contacts CP1–CP16 on the chip 22, and the address conductors LA1–LA10 on the TAB circuit 32 are connected to the corresponding address contacts CA1–CA10 on the chip 22. The pull-down contacts CQ1P, CQ2P, CQ3P, and CQ4P on the chip 22 are connected to the common ground return. Quad select jumper conductors JQ3 and JQ4 on the TAB circuit 32 short the quad select contacts CQ3 and CQ4 to the quad select conductors LQ1 and LQ2, respectively.

Thus, the configuration of TAB circuit conductors shown in FIG. 3B shorts quad select signal lines Q1 to Q3 and Q2 to Q4. In this manner, the number of independently-addressable quad select groups is reduced from four to two, with 160($p_2$×n=16×10) of the ink-heating resistors R1–R320 in each of the eight quad select groups. This provides an addressing scheme of sixteen primitive signals ($p=p_2=16$), two quad select signals ($q=q_2=2$), and ten address signals (n=10), for a total of twenty-eight control signals communicated from the printer controller 16 to the chip 22.

Figure 6B:
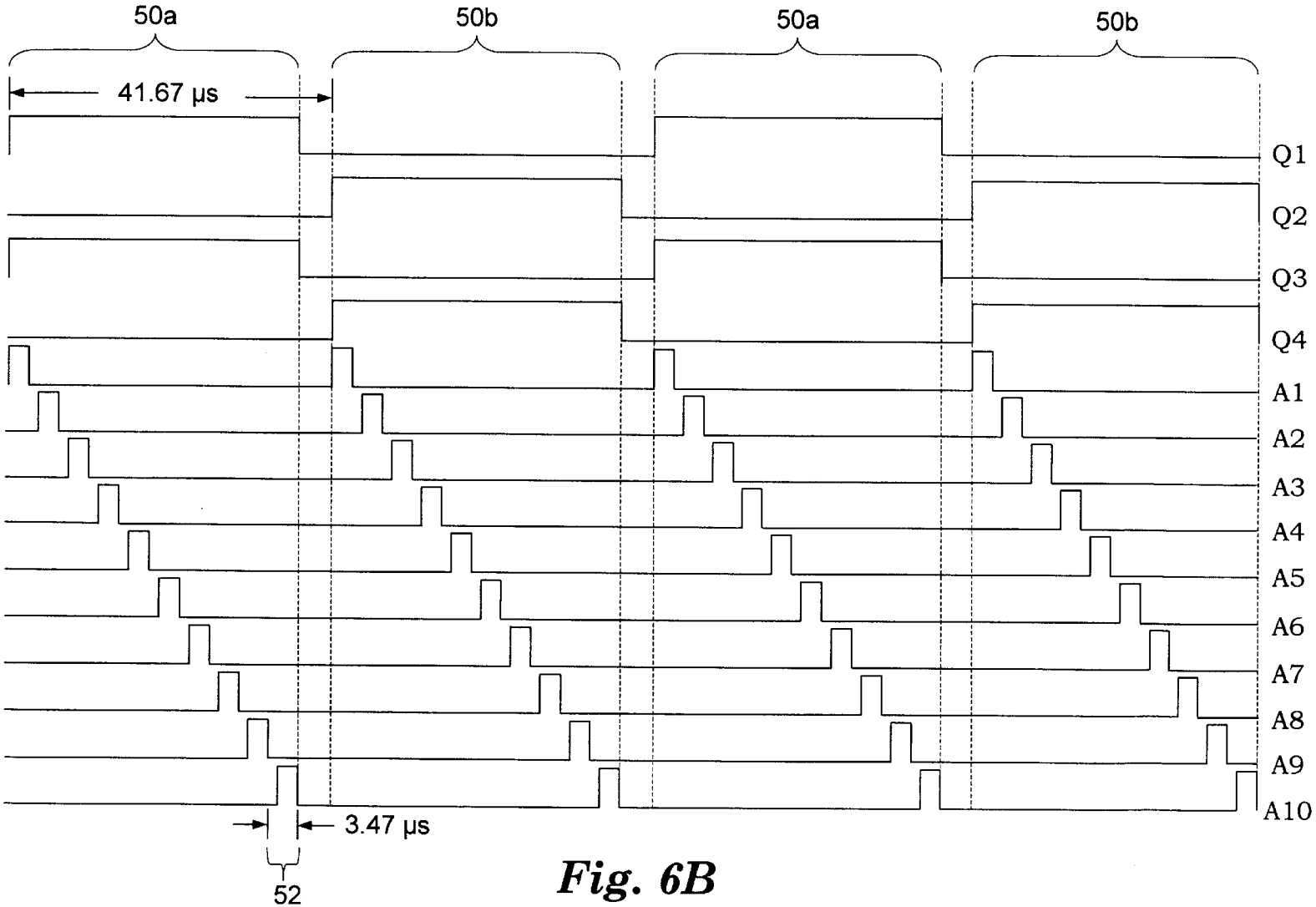

FIG. 6B is a timing diagram depicting the preferred signal timing scheme when the print head chip 22 is addressed in the second operating mode. As shown in FIG. 6B, the quad select signals on the quad select lines Q1 and Q3 are high simultaneously during quad select windows 50*a*. Subsequently, the quad select signals on the quad select lines Q2 and Q4 are high simultaneously during quad select windows 50*b*. Preferably, each quad select window 50*a*–50*b* endures for approximately 41.67 μs. During each quad select window 50*a*–50*b*, each of the address signals on the address lines A1–A10 go high within sequential address windows 52 of approximately 3.47 μs duration. During any address window 52, the printer controller 16 may drive any or all of the primitive signals high on the sixteen primitive lines P1–P16 as determined by the image data. Thus, in this second operating mode, there are twenty ($q_2$×n=2×10) groups of resistors that are enabled sequentially as the print head 20 scans across the print medium 14, and the sixteen resistors in any one of these twenty groups may be activated simultaneously when the group is enabled.

In the preferred embodiment of the invention, the scan speed of the print head 20 in the second operating mode is approximately 20.0 inch/second. Thus, during one address window 52, the print head 20 travels approximately $6.93\times10^{-5}$ inch in the scan direction. During one quad select window 50*a*–50*b* in the second operating mode, the print head 12 travels approximately the same distance (1/1200 inch) as during one quad select window 46*a*–46*d* in the first operating mode. However, in the second operating mode, all of the resistors R1–R320 may be addressed in during the time required for the print head 20 to travels 2/1200 (or 1/600) inch. Thus, the second operating mode requires only two passes of the print head 20 across the print medium 14 to fill all possible print positions in a print swath. Therefore, the invention operating in the second operating mode prints much faster than when operating in the first mode. However, the second implementation is more expensive to manufacture due to the larger number of primitive lines P1–P16.

It is contemplated, and will be apparent to those skilled in the art from the preceding description and the accompanying drawings that modifications and/or changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. An ink jet print head for use in an ink jet printing device, the print head controllable based at least in part on q number of first control signals and p number of third control signals, the print head comprising:

a print head integrated circuit chip having:

ink-heating resistors for generating heat when activated, each having a high side and a low side, the high side of each of the ink-heating resistors coupled to one of the p number of third control signals; and a switching circuit operable in either a first operating mode or a second operating mode, the switching circuit for selecting at least one of the ink-heating resistors for activation by coupling the low side of a selected ink-heating resistor to a common ground return, thereby allowing electrical current to flow through the selected ink-heating resistor, the switching circuit for selecting the selected ink-heating resistor depending at least in part on a state of the first control signal, where q is equivalent to $q_1$ in the first operating mode, where q is equivalent to $q_2$ in the second operating mode, where $q_1$ is equivalent to twice $q_2$, where p is equivalent to $p_1$ in the first operating mode, where p is equivalent to $p_2$ in the second operating mode, where $p_2$ is equivalent to twice $p_1$, and where the product of $q_1$ multiplied by $p_1$ in the first operating mode is equivalent to the product of $q_2$ multiplied by $p_2$ in the second operating mode; and operating mode selection means connected to the print head integrated circuit for determining, based on a configuration of the operating mode selection means, whether the switching circuit operates in the first operating mode or the second operating mode.

2. The ink jet print head of claim 1 further controllable based at least in part on n number of second control signals, wherein the print head integrated circuit chip further comprises:

at least $q_1$ multiplied by $p_1$ multiplied by n number of the ink-heating resistors; and the switching circuit further for receiving the second control signals, and for selecting the selected ink-heating resistor based at least in part on states of the first and second control signals, where the value of n in the first operating mode is equivalent to the value of n in the second operating mode.

3. The ink jet print head of claim 2 wherein:

the ink-heating resistors further comprise $q_1$×n number of groups of ink-heating resistors, each group including $p_1$ number of ink-heating resistors that may be simultaneously activated; and the switching circuit is operable in the first operating mode to sequentially enable activation of each of the $q_1$×n number of groups based on the first and third control signals, and for activating any one of the ink-heating resistors within an enabled group based on the second control signal.

4. The ink jet print head of claim 2 wherein:

the ink-heating resistors further comprise $q_2$×n number of groups of ink-heating resistors, each group including $p_2$ number of ink-heating resistors that may be simultaneously activated; and the switching circuit is operable in the second operating mode to sequentially enable activation of each of the $q_2$×n number of groups based on the first and third control signals, and for activating any one of the ink-heating resistors within an enabled group based on the second control signal.

5. The ink jet print head of claim 2, wherein the switching circuit further comprises:

$q_1$ number of first electrical contacts for receiving the first control signals;

$p_2$ number of third electrical contacts for receiving the third control signals; and n number of second electrical contacts for receiving the second control signals.

6. The ink jet print head of claim 5, wherein the operating mode selection means further comprise an interconnection circuit for providing electrical connections between the ink jet printing device and the switching circuit on the print head integrated circuit, the interconnection circuit having:

first conductive lines for providing electrical connection between the ink jet printing device and at least some of first electrical contacts;

second conductive lines for providing electrical connection between the ink jet printing device and at least some of the second electrical contacts;

third conductive lines for providing electrical connection between the ink jet printing device and at least some of the third electrical contacts; and jumper lines for shorting some of the third electrical contacts together in the first operating mode.

7. The ink jet print head of claim 6, wherein the interconnection circuit further comprises:

at least $q_1$ number of the first conductive lines for providing electrical connection between the ink jet printing device and the at least $q_1$ number of the first electrical contacts;

at least $p_1$ number of the third conductive lines for providing electrical connection between the ink jet printing device and a first half of the $p_2$ number of the third electrical contacts; and at least $p_1$ number of the jumper lines for shorting the at least $p_1$ number of the third conductive lines to a second half of the $p_2$ number of the third electrical contacts.

8. The ink jet print head of claim 6, wherein the interconnection circuit further comprises a flexible tape automated bonding (TAB) circuit, and the first, second, third, and jumper conductive lines further comprise conductive metal traces in the TAB circuit.

9. The ink jet print head of claim 6 wherein the print head integrated circuit further comprises:

$q_1$ number of select groups of ink-heating resistors corresponding to the $q_1$ number of first electrical contacts, each select group consisting of $p_1 \times n$ number of ink-heating resistors, each select group being independently addressable by one of the $q_1$ number of first control signals; and $p_2$ number of primitive groups corresponding to the $p_2$ number of third electrical contacts, each primitive group consisting of $q_2 \times n$ number of ink-heating resistors, each primitive group being independently addressable by one of the $p_2$ number of third control signals.

10. The ink jet print head of claim 5, wherein the operating mode selection means further comprise an interconnection circuit for providing electrical connections between the ink jet printing device and the switching circuit on the print head integrated circuit, the interconnection circuit having:

first conductive lines for providing electrical connection between the ink jet printing device and at least some of first electrical contacts;

second conductive lines for providing electrical connection between the ink jet printing device and at least some of the second electrical contacts;

jumper lines for shorting some of the first electrical contacts together in the second operating mode; and third conductive lines for providing electrical connection between the ink jet printing device and at least some of the third electrical contacts.

11. The ink jet print head of claim 10, wherein the interconnection circuit further comprises:

at least $p_2$ number of the third conductive lines for providing electrical connection between the ink jet printing device and the at least $p_2$ number of the third electrical contacts;

at least $q_2$ number of the first conductive lines for providing electrical connection between the ink jet printing device and a first half of the $q_1$ number of the first electrical contacts; and at least $q_2$ number of the jumper lines for shorting at least $q_2$ number of the first conductive lines to a second half of the $q_1$ number of the first electrical contacts.

12. The ink jet print head of claim 10, wherein the interconnection circuit further comprises a flexible tape automated bonding (TAB) circuit, and the first, second, third, and jumper conductive lines further comprise conductive metal traces in the TAB circuit.

13. The ink jet print head of claim 5 further comprising:

at least $q_1$ multiplied by $p_1$ multiplied by n number of the ink-heating resistors; and the switching circuit having:

at least $q_1$ multiplied by $p_1$ multiplied by n number of first switching devices, each first switching device associated with a corresponding one of the ink-heating resistors, each first switching device having a first control input for receiving one of the first control signals, a first high-side input for receiving one of the second control signals, and a first low-side output; and at least $q_1$ multiplied by $p_1$ multiplied by n number of second switching devices, each second switching device associated with a corresponding one of the first switching devices and associated with a corresponding one of the ink-heating resistors, each second switching device having a second high-side input connected to the low side of an associated ink-heating resistor, a second control input connected to the first low-side output of an associated first switching device, and a second low-side output connected to the common ground return.

14. The ink jet print head of claim 13 wherein:

the first switching devices are field effect transistors having a first gate, a first source, and a first drain, the first gate being the first control input, the first drain being the first high-side input, and the first source being the first low-side output; and the second switching devices are power field effect transistors having a second gate, a second source, and a second drain, the second gate being the second control input, the second drain being the second high-side input, and the second source being the second low-side output.

15. The ink jet print head of claim 14 wherein any one of the ink-heating resistors is activated by an electrical current flowing through the resistor when the first control signal is high on the first gate of the corresponding first switching device, the third control signal is high on the high side of the resistor, and the second control signal is high on the first drain of the first switching device.

16. The ink jet print head of claim 14 wherein the operating mode selection means have $p_1$ number of jumper conductors when in the first operating mode for shorting a first half of the $p_2$ number of the third electrical contacts to a second half of the $p_2$ number of the third electrical contacts, thereby reducing the number of primitive groups to $p_1$ and increasing the number of ink-heating resistors in each of the primitive groups to $q_1 \times n$, each of the $p_1$ number of primitive groups being independently addressable by $p_1$ number of the third control signals.

17. The ink jet print head of claim 14 wherein the operating mode selection means have $q_2$ number of jumper conductors when in the second operating mode for shorting a first half of the $q_1$ number of the first electrical contacts to a second half of the $q_1$ number of the first electrical contacts, thereby reducing the number of select groups to $q_2$ and increasing the number of ink-heating resistors in each of the select groups to $p_2 \times n$, each of the $q_2$ number of select groups being independently addressable by $q_2$ number of the first control signals.

18. The ink jet print head of claim 2, where $q_1$ is four, $p_1$ is eight, and n is ten in the first operating mode.

19. The ink jet print head of claim 2, where $q_2$ is two, $p_2$ is sixteen, and n is ten in the second operating mode.

20. An ink jet print head for use in an ink jet printing device, the print head controllable based at least in part on q number of first control signals, p number of third control signals, and n number of second control signals, the print head comprising:

a print head integrated circuit chip having:

at least one ink-heating resistor for generating heat when activated, the at least one ink-heating resistor having a high side and a low side, the high side coupled to one of the third control signals; and a switching circuit operable in either a first operating mode or a second operating mode for selecting the at least one ink-heating resistor for activation by connecting the low side of the at least one ink-heating resistor to a common ground return based at least in part on states of the first and second control signals, where q is equivalent to $q_1$ in the first operating mode, where q is equivalent to $q_2$ in the second operating mode, where $q_1$ is greater than $q_2$, where p is equivalent to $p_1$ in the first operating mode, where p is equivalent to $p_2$ in the second operating mode, and where $p_2$ is greater than $p_1$; and operating mode selection means connected to the print head integrated circuit for determining, based on a configuration of the operating mode selection means, whether the switching circuit operates in the first operating mode or the second operating mode.

21. An ink jet print head for use in an ink jet printing device, the print head controllable based at least in part on q number of first control signals, n number of second control signals, and p number of third control signals, the print head comprising:

a print head integrated circuit chip having:

ink-heating resistors for generating heat when activated; and switching circuits operable in either a first operating mode or a second operating mode for selectively activating the ink-heating resistors based at least in part on the first, second, and third control signals, each of the switching circuits comprising a first switching device and a second switching device, the first switching device coupled to at least one of the first control signals and at least one of the second control signals, the first switching device for connecting or disconnecting the at least one second control signal to or from the second switching device depending on a state of the at least one first control signal, and the second switching device coupled to the first switching device and to an associated one of the ink-heating resistors, the second switching device for activating the associated one of the ink-heating resistors based at least in part on a state of the at least one second control signal, where q is equivalent to $q_1$ in the first operating mode, where q is equivalent to $q_2$ in the second operating mode, where $q_1$ is equivalent to twice $q_2$, where p is equivalent to $p_1$ in the first operating mode, where p is equivalent to $p_2$ in the second operating mode, where $p_2$ is equivalent to twice $p_1$, and where the product of $q_1$ multiplied by $p_1$ in the first operating mode is equivalent to the product of $q_2$ multiplied by $p_2$ in the second operating mode; and operating mode selection means connected to the print head integrated circuit for determining, based on a configuration of the operating mode selection means, whether the switching circuit operates in the first operating mode or the second operating mode.

22. An ink jet print head for use in an ink jet printing device, the print head controllable based at least in part on q number of first control signals, n number of second control signals, and p number of third control signals, the print head comprising:

a print head integrated circuit chip having:

ink-heating resistors for generating heat when activated; and a switching circuit for receiving the first, second, and third control signals, and for selectively activating the ink-heating resistors based at least in part on the first, second, and third control signals, the switching circuit operable in either a first operating mode or a second operating mode, where q is equivalent to $q_1$ in the first operating mode, where q is equivalent to $q_2$ in the second operating mode, where $q_1$ is equivalent to twice $q_2$, where p is equivalent to $p_1$ in the first operating mode, where p is equivalent to $p_2$ in the second operating mode, where $p_2$ is equivalent to twice $p_1$, and where the product of $q_1$ multiplied by $p_1$ in the first operating mode is equivalent to the product of $q_2$ multiplied by $p_2$ in the second operating mode, the switching circuit including $q_1$ number of first electrical contacts for receiving the first control signals, $p_2$ number of third electrical contacts for receiving the third control signals, and n number of second electrical contacts for receiving the second control signals; and operating mode selection means connected to the print head integrated circuit for determining, based on a configuration of the operating mode selection means, whether the switching circuit operates in the first operating mode or the second operating mode, the operating mode selection means comprising an interconnection circuit for providing electrical connections between the ink jet printing device and the switching circuit on the print head integrated circuit, the interconnection circuit having:

first conductive lines for providing electrical connection between the ink jet printing device and at least some of first electrical contacts;

second conductive lines for providing electrical connection between the ink jet printing device and at least some of the second electrical contacts;

third conductive lines for providing electrical connection between the ink jet printing device and at least some of the third electrical contacts; and jumper lines for shorting some of the third electrical contacts together in the first operating mode.

23. An ink jet print head for use in an ink jet printing device, the print head controllable based at least in part on q number of first control signals, n number of second control signals, and p number of third control signals, the print head comprising:

a print head integrated circuit chip having:

ink-heating resistors for generating heat when activated; and a switching circuit for receiving the first, second, and third control signals, and for selectively activating the ink-heating resistors based at least in part on the first, second, and third control signals, the switching circuit operable in either a first operating mode or a second operating mode, where q is equivalent to $q_1$ in the first operating mode, where q is equivalent to $q_2$ in the second operating mode, where $q_1$ is equivalent to twice $q_2$, where p is equivalent to $p_1$ in the first operating mode, where p is equivalent to $p_2$ in the second operating mode, where $p_2$ is equivalent to twice $p_1$, and where the product of $q_1$ multiplied by $p_1$ in the first operating mode is equivalent to the product of $q_2$ multiplied by $p_2$ in the second operating mode, the switching circuit including $q_1$ number of first electrical contacts for receiving the first control signals, $p_2$ number of third electrical contacts for receiving the third control signals, and n number of second electrical contacts for receiving the second control signals; and operating mode selection means connected to the print head integrated circuit for determining, based on a configuration of the operating mode selection means, whether the switching circuit operates in the first operating mode or the second operating mode, the operating mode selection means comprising an interconnection circuit for providing electrical connections between the ink jet printing device and the switching circuit on the print head integrated circuit, the interconnection circuit having:

first conductive lines for providing electrical connection between the ink jet printing device and at least some of first electrical contacts;

second conductive lines for providing electrical connection between the ink jet printing device and at least some of the second electrical contacts;

third conductive lines for providing electrical connection between the ink jet printing device and at least some of the third electrical contacts; and jumper lines for shorting some of the first electrical contacts together in the second operating mode.

* * * * *